US011133167B2

(12) United States Patent
Haufler

(10) Patent No.: US 11,133,167 B2
(45) Date of Patent: Sep. 28, 2021

(54) INTEGRATED LOW COST CURTAIN PLATE, ORIFICE PCB AND ION LENS ASSEMBLY

(71) Applicant: DH Technologies Development Pte. Ltd., Singapore (SG)

(72) Inventor: Robert Haufler, Toronto (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 16/977,762

(22) PCT Filed: Mar. 1, 2019

(86) PCT No.: PCT/IB2019/051685
§ 371 (c)(1),
(2) Date: Sep. 2, 2020

(87) PCT Pub. No.: WO2019/167026
PCT Pub. Date: Sep. 6, 2019

(65) Prior Publication Data

US 2021/0005441 A1 Jan. 7, 2021

Related U.S. Application Data

(60) Provisional application No. 62/811,867, filed on Feb. 28, 2019, provisional application No. 62/637,710, filed on Mar. 2, 2018.

(51) Int. Cl.
*H01J 49/06* (2006.01)
*H01J 49/04* (2006.01)
(Continued)

(52) U.S. Cl.
CPC ..... *H01J 49/067* (2013.01); *H01J 49/022* (2013.01); *H01J 49/044* (2013.01); *H01J 49/062* (2013.01); *H01J 49/24* (2013.01)

(58) Field of Classification Search
CPC ..... H01J 49/067; H01J 49/044; H01J 49/062; H01J 49/24; H01J 49/02; H01J 49/022
(Continued)

(56) References Cited

U.S. PATENT DOCUMENTS 5,481,107 A * 1/1996 Takada ..... G01N 30/728 250/281
7,060,976 B2 6/2006 Sheehan et al.
(Continued)

OTHER PUBLICATIONS

International Search Report and Written Opinion for PCT/IB2019/051685 dated Jul. 30, 2019.

*Primary Examiner* — Kiet T Nguyen

(57) ABSTRACT

In one aspect, a curtain and orifice plate assembly for use in a mass spectrometry system is disclosed, which comprises a curtain plate including a first printed circuit board (PCB) having an aperture configured for receiving ions generated by an ion source of the mass spectrometry system and at least one gas-flow channel, where said first PCB has at least one metal coating disposed on at least a portion thereof. The assembly further includes an orifice plate coupled to the curtain plate, which includes a PCB providing an orifice that is substantially aligned with the aperture of the curtain plate so that the ions entering the assembly via said aperture of the curtain plate can exit the assembly via said orifice of the orifice plate, where the second PCB has at least one metal coating disposed on at least a portion thereof.

36 Claims, 26 Drawing Sheets

(51) Int. Cl.
*H01J 49/24* (2006.01)
*H01J 49/02* (2006.01)

(58) Field of Classification Search
USPC ..... 250/396 R, 281, 282
See application file for complete search history.

(56) References Cited

U.S. PATENT DOCUMENTS

2014/0103207 A1 4/2014 Sampei
2014/0319338 A1 10/2014 Thomson et al.

* cited by examiner (A)

(B)

(C)

(A) (B) (C)

(A) (B) (C)

(A)

(B)

(A)

(B)

INTEGRATED LOW COST CURTAIN PLATE, ORIFICE PCB AND ION LENS ASSEMBLY

RELATED APPLICATIONS

This application claims priority to U.S. provisional application No. 62/637,710 filed on Mar. 2, 2018, entitled "Integrated Low Cost Curtain Plate and Orifice PCB Assembly," which is incorporated herein by reference in its entirety and to U.S. provisional application No. 62/811,867 filed on Feb. 28, 2019, entitled "Integrated Low Cost Curtain Plate, Orifice PCB and Ion Lens Assembly," which is incorporated herein by reference in its entirety.

BACKGROUND

The present invention is generally directed to an integrated curtain plate/orifice plate assembly for use in a mass spectrometer. Furthermore, the present disclosure relates to an apparatus and methods for direct heating of a lens to prevent deposits from forming on the lens and/or to remove deposited contamination from a surface of the lens.

In many mass spectrometers, ions generated by an ion source are successively transmitted through a curtain plate and an orifice plate to reach downstream components of the mass spectrometer, such as lenses, quadrupole analyzers, etc. Typically, a gas flows in the space between the curtain plate and the orifice plate, e.g., to prevent neutral species and/or other contaminants from reaching the downstream components.

The curtain/orifice plate combinations that are employed in conventional mass spectrometers are typically too large, expensive and complex to be viable for use in a low-cost mass spectrometer, which would still maintain an acceptable level of reproducibility, stability and sensitivity. Moreover, in a conventional mass spectrometer, the curtain plate and the orifice plate can become contaminated during the use of the spectrometer. The cleaning of the curtain and the orifice plates can be time consuming and can limit the use of the spectrometer.

Accordingly, there is a need for more versatile curtain plate/orifice plate combinations.

Furthermore, ionization at atmospheric pressure, for example, by chemical ionization or electrospray, is generally a highly efficient means of ionizing molecules within a sample. Atmospheric ionization of ions can create analytes of interests, as well as interfering/contaminating ions and neutral molecules in high abundance. In mass spectrometry systems, it is generally desirable, for example, to channel, focus, manipulate, and detect ions while under vacuum. During operation, created ions as well as the interfering/contaminating ions can contact, stick to, and/or deposit on surfaces within the mass spectrometry system.

SUMMARY

In one aspect, a curtain and orifice plate assembly for use in a mass spectrometry system is disclosed, which comprises a curtain plate including a first printed circuit board (PCB) having an aperture configured for receiving at least a portion of the ions generated by an ion source of the mass spectrometry system and at least one gas-flow channel, where said first PCB has at least one metal coating disposed on at least a portion thereof. The assembly further includes an orifice plate coupled to the curtain plate, which includes a second PCB providing an orifice that is substantially aligned with the aperture of the curtain plate so that the ions entering the assembly via said aperture of the curtain plate can exit the assembly via said orifice of the orifice plate, where the second PCB has at least one metal coating disposed on at least a portion thereof. The orifice plate is coupled to the curtain plate such that said at least one gas-flow channel of the curtain plate provides a gap between the curtain plate and the orifice plate through which a gas flow can be established between the plates.

In some embodiments, the curtain plate can include an inlet port through which a gas can be introduced into the assembly and an outlet port through which the introduced gas can exit the assembly. In some such embodiments, the gas introduced into the assembly can exit the assembly via the aperture of the curtain plate, i.e., the ion-receiving aperture of the curtain plate functions as the outlet port.

The metal coatings of the curtain plate and the orifice plate can be configured to allow applying electrical voltages to the plates. In some embodiments, a voltage applied to the curtain plate can generate an electric field, e.g., in the vicinity of the ion-receiving aperture of the curtain plate, that attracts incoming ions to the curtain plate. In some embodiments, a voltage differential is applied to the plates to generate an electric field within the assembly suitable for facilitating the passage of the ions through the assembly. By way of example, and without limitation, electrical voltages in a range of about −800 volts (DC) to about +800 volts (DC) can be applied to any of the curtain plate and the orifice plate.

In some embodiments, the curtain plate can be formed of a metalized PCB that includes a front surface, i.e., a surface facing incoming ions, and a back surface, i.e., a surface facing the orifice plate, with the ion-receiving aperture extending from the front surface to the back surface. In some such embodiments, the metal coating of the curtain plate can include a first metal coating that covers at least a portion of the front surface of the curtain plate and at least partially surrounds the aperture. Further, the curtain plate can include a second metal coating disposed on its back surface that covers at least a portion of the back surface and at least partially surrounds the ion-receiving aperture of the curtain plate. By way of example, the metal coating associated with the back surface of the curtain plate can include a first metal portion that surrounds the aperture and a second metal portion radially spaced from the first portion and at least partially surrounding the first portion. In some such embodiments, a plurality of radially extending metalized gas-flow channels can electrically connect the first metal portion to the second metal portion.

In some embodiments, the curtain plate can include at least one metalized tab (herein also referred to as a finger) for electrically connecting at least one of the first and second metal coatings to a voltage source. In some such embodiments, the metalized tab electrically connects the metal coating disposed on the front surface to the metal coating disposed on the back surface so these coatings can be maintained at a single electrical potential via application of a voltage thereto.

Further, the orifice plate can also include a front surface, i.e., a surface facing the curtain plate, and a back surface, i.e., a surface facing downstream components such as one or more analyzers of a mass spectrometer in which the integrated curtain plate/orifice plate assembly is incorporated. In some embodiments, a first metal coating is disposed on the front surface of the orifice plate and a second metal coating is disposed on the back surface of the orifice plate. In some such embodiments, the first metal coating can include a first metal portion and a second metal portion that is radially separated from the first metal portion and electrically insulated therefrom via a non-metalized portion of the PCB. Each of the first and second metal portions of the orifice plate can partially, or in some cases completely, encircle the orifice of the orifice plate.

Similar to the metal coatings of the curtain plate, the metal coatings of the orifice plate can be formed of a variety of metals. By way of example, the metal coatings of the orifice and the curtain plates can be formed of gold-plated copper, gold, tin, silver or other suitable metals. For example, in one embodiment, copper can be coated with nickel and the nickel can then be coated with gold (e.g., via electrochemical deposition). Further, the metal coatings of the orifice and curtain plates can have a thickness, for example, in a range of about 20 to about 40 microns, though other suitable thicknesses can also be employed. For example, in one embodiment in which the metal coatings are formed by depositing a layer of nickel on copper and coating the nickel with gold, the copper layer can have, for example, a thickness of about 35 microns, and the thickness of the nickel layer can be, for example, in a range of about 3 microns to about 6 microns, and the thickness of the gold layer can be, for example, in a range of about 0.075 microns to about 0.125 microns.

In some embodiments, the orifice plate can include a heating element, e.g., a resistive heating element, for heating the curtain gas flowing in the space between the curtain plate and the orifice plate through which the ions travel. By way of example, in some embodiments, a helical resistive element can be disposed on the front surface of the orifice plate. The resistive element can be activated, e.g., via application of a voltage (current) thereto, to generate heat.

In a related aspect, a mass spectrometer is disclosed, which includes an ion source for generating ions and a curtain plate/orifice plate assembly according to the present teachings, which is disposed downstream of the ion source to receive at least a portion of the ions generated by the ion source. A mass analyzer is disposed downstream of the curtain plate/orifice plate assembly to receive at least a portion of the ions passing through the assembly and to analyze those ions based on their mass-to-charge ratios.

Furthermore, the present disclosure encompasses a recognition that in mass spectrometry systems contamination from ions and possibly neutral species that impinge on surfaces of such mass spectrometry systems can hinder transmission of ions in a variety of different ways. In particular, contamination from deposits on ion lenses can cause diminished performance in mass spectrometry systems. The present disclosure further encompasses a recognition that there is a need in mass spectrometry systems for ions lenses that are configured to inhibit contamination from ions and neutral species that impinge on lens surfaces and/or for ions lenses that are configured to reduce contamination present on the lens surfaces.

Among other things, the present disclosure provides ion lens assemblies for use in mass spectrometry systems. In some embodiments, an ion lens assembly includes a plurality of layers, including a front cap layer having a forward surface that is arranged to face incoming ions, a rear layer, and a heating element disposed between the front cap layer and the rear layer. In some embodiments, each layer of the ion lens assembly includes an opening therethrough, where the openings are substantially aligned and sized to allow passage of ions through the ion lens assembly.

In some embodiments, the front cap layer and the rear layer of the ion lens assembly can be electrically conductive. For example, these layers can be at least partially formed from an electrical conductor and/or an electrically conductive material. In some embodiments, each of the front cap layer and/or the rear layer of the ion lens assembly can be at least partially formed from a metal. In some embodiments, for example, the rear layer and/or front cap layer of the ion lens assembly can be formed from aluminum, aluminum alloy(s), beryllium, brass, chromium, copper, gold, indium, iron, molybdenum, nickel, niobium, platinum, palladium, stainless steel(s), tantalum, titanium, tungsten, and/or zirconium. In some embodiments, the front cap layer can be in the form of a thin film coating. In some embodiments, the front cap layer and the rear layer can have a voltage applied. In some embodiments, the front cap layer and the rear layer can be maintained at the same electrical potential, for example, via the same voltage applied.

In some embodiments, the rear layer of the ion lens assembly can be electrically insulating. For example, in some embodiments, the rear layer of the ion lens assembly can be at least partially formed from a dielectric material, glass, plastic, ceramic, natural crystal, paper, natural or synthetic polymeric material, stone, and/or or non-conductive metal oxide film. In some embodiments, for example, the ceramic can be aluminum oxide, aluminum nitride, beryllium oxide, silicon carbide, sapphire, silicon nitride, and/or zirconia.

As noted above, in some embodiments, the ion lens assembly can include a heating element. In some embodiments, the heating element can be disposed between the rear layer and the front cap layer of the ion lens assembly. In some embodiments, the heating element can be configured such that it will heat the ion lens assembly to a temperature of about 100° C. to about 300° C.

In some embodiments, the heating element can include a resistive electrical trace, which can generate heat in response to application of an electrical power thereto. In some embodiments, the heating element can include a plurality of pins for electrically connecting to a power source. By way of example, in some embodiments, the heating element can be coupled to any of a power supply, a controller, and/or a driver. In some embodiments, the heating element can include a flexible heater. In some embodiments, the heating element can include a thermoelectric device. In some embodiments, the heating element can be electrically isolated from the front cap layer and the rear layer.

In some embodiments, the heating element can include one or more channels, conduits, fluidic pathways, tubes, tunnels, etc. that extend in and/or between layers of the lens assembly having a heated fluid flowing therethrough. By way of example, such channels, conduits, fluidic pathways, passages, tubes, tunnels, etc. can be configured and/or plumbed to transport or flow a fluid therethrough. In some embodiments, the fluid can include, for example, alcohol, ammonia, glycerine, glycol, and/or water. In some embodiments, the fluid can be preheated to an elevated temperature, for example, between about 100° C. and about 300° C. In some embodiments, the fluid can include two or more reagents that upon contact exothermically react to generate heat.

In some embodiments, the ion lens assembly can include a temperature sensor. The temperature sensor can be configured to sense and report the temperature of the ion lens assembly. By way of example, in some embodiments, the temperature sensor can be a resistance temperature detector (RTD). In some embodiments, the temperature sensor is a resistive electrical trace, for example, formed of a metal, which is incorporated in the heating element and can include a plurality of pins for electrical connection to a measuring device. The measuring device can measure the resistance of the resistive trace and correlate the measured resistance to a temperature. In some embodiments, the temperature sensor can include a thermistor or a thermocouple. In some embodiments, the temperature sensor can be disposed between the front cap layer and the rear layer. In some embodiments, the temperature sensor can be mounted to the front cap layer or the rear layer, for example, to an external surface thereof.

In some embodiments, the ion lens assembly can include a first insulating layer disposed between the front cap layer and the heating element. In some embodiments, the ion lens assembly can include a second insulating layer disposed between the heating element and the rear layer. In some embodiments, the first and second insulting layers can be formed from a thin film coating. In some embodiments, the first and second insulting layers can be formed from a dielectric material; glass, plastic, ceramic, natural crystal, paper, natural or synthetic polymeric material, stone, and/or or non-conductive metal oxide film. In some embodiments, for example, the ceramic can be aluminum oxide, aluminum nitride, beryllium oxide, silicon carbide, sapphire, silicon nitride, and/or zirconia.

In some embodiments, each layer of the ion lens assembly can include an opening therethrough, where the openings of the different layers are substantially aligned and sized to allow passage of ions through the ion lens assembly. In some embodiments, an opening in at least one layer, and in some cases in all layers, of the ion lens assembly can be approximately circular. In some embodiments, such an opening can have at least one dimension, for example, diameter, in a range of about 0.010 mm to about 10 mm.

In some embodiments, the ion lens assembly can have a thickness of about 0.025 mm to about 10 mm, wherein the thickness can be from the forward surface of the front cap layer to a backward surface of the rear layer. With respect to the geometry of the mass spectrometry system and the ion path and for purposes throughout, a forward surface of an ion lens assembly or any layer of an ion lens assembly will be the surface that the ions pass by first when transiting through the lens. Furthermore, with respect to the geometry of the mass spectrometry system and the ion path for purposes throughout, a backward surface of an ion lens assembly or any layer of an ion lens assembly will be the surface that the ions pass by last when transiting through the lens.

In some embodiments, the present disclosure provides a mass spectrometry system, which can include an ion source for generating ions and one or more ion guide chambers positioned downstream from the ion source for receiving ions. In some embodiments, the one or more ion guide chambers can include an inlet orifice for receiving ions generated from the ion source and an exit orifice for transmitting ions to a downstream component, for example, a mass analyzer. In some such embodiments, an ion lens assembly according to the present teachings can be positioned in proximity of any of the inlet orifice or exit orifice of at least one of the ion guide chamber.

As noted above, in some embodiments, an ion lens assembly according to the present teachings can include a temperature sensor for measuring the temperature of the ion lens assembly. In some such embodiments, the temperature sensor is electrically coupled to a feedback circuit, which can in turn control a voltage source configured to apply a voltage (for example, a dc voltage) to a heating element incorporated in the ion lens assembly. The temperature sensor can provide signals indicative of the temperature of the ion lens assembly to the feedback circuit, which can in turn adjust the voltage applied by the voltage source to the heating element of the ion lens assembly so as to maintain the temperature of the ion lens assembly within a desired range. For example, if the temperature data indicates a temperature greater than a predefined upper threshold, the feedback circuit can cause the voltage source to lower the voltage applied to the heating element and if the temperature data indicates a temperature lower than a predefined lower threshold, the feedback circuit can cause the voltage source to increase the voltage applied to the heating element.

In some embodiments, the present disclosure provides methods of fabricating an ion lens assembly. In some embodiments, such methods can include a step of providing a rear layer formed of an electrically insulating material and having an opening, for example, a central opening, shaped and sized to allow passage of ions therethrough. A heating element can then be coupled to the forward surface of the rear layer. For example, the heating element can be in the form of a metallic resistive trace that is deposited on the forward surface of the rear layer in a manner that would not occlude the opening formed in the rear layer. For example, the resistive trace can be an element of the rear layer. For example, in some embodiments, a metallic resistive trace can be deposited on a forward surface of the rear layer. An insulating layer having an opening for passage of ions therethrough can then be disposed on the heating element and a front electrically conductive layer having an opening for passage of ions can be disposed on the insulating layer. By way of example, in some embodiments, the front layer can be in the form of a thin metal coating that is deposited on a surface of the insulating layer opposed to the surface that is in contact with the heating element. The rear layer, the insulting layer and the front layer are assembled such that their respective openings are substantially aligned to allow the passage of an ion beam therethrough. In some embodiments, during the step of disposing the heating element on the forward surface of the rear layer, a temperature sensor, for example, in the form of a resistive trace, can also be disposed on the forward surface of the rear layer.

In another embodiment, a method of fabricating an ion lens assembly according to the present teachings, the rear layer can be formed of an electrically conducting material, for example, a metal. In such an embodiment, a first insulating layer is disposed on the forward surface of the rear layer and a heating element, for example, in the form of a resistive trace, is then deposited on a surface of the insulating layer that is opposed to the surface that is in contact with the rear layer. In some such embodiments, a temperature sensor can also be deposited on the surface of the insulating layer. In some embodiments, a second insulating layer can be deposited on the heating element following by the depositing a metal layer on a surface of the second insulating layer that is opposed to the surface that is contact with the heating element so as to form the front cap layer.

For example, in some embodiments, a method of assembly of an ion lens assembly according to the present teachings can comprise providing a metal lens, the lens piece can be square or round, or other suitable shape, with an aperture of appropriate dimension in an appropriate location. The front surface can be coated with a dielectric. The resistive trace can be attached to the dielectric, ensuring that no contact occurs with the lens. The resistive trace can be glued, deposited using physical deposition processes or printed using suitable technology as known in the art. A temperature sensing device can be attached in a similar fashion. It can be a resistive thermally varying trace (RTD) or thermocouple. The resistive trace and RTD trace can be coated with a second dielectric cover. The second dielectric coating can be coated with conductive coating, ensuring electrical contact to the resistive heating trace and RTD trace does not occur. The design should ensure that electrical contact is possible with the resistive trace and RTD trace and that the lens is in electrical contact with the lens power supply as well as the final conductive coating. The final conductive coating and the lens can be in electrical contact to the same voltage source.

In another example, in some embodiments, a method of assembly of an ion lens assembly according to the present teachings can comprise providing a ceramic lens, the lens piece can be square or round, or other suitable shape, with an aperture of appropriate dimension in an appropriate location. The resistive trace can be attached to the ceramic lens. The resistive trace can be glued, deposited using physical deposition processes or printed using appropriate technology as known in the art. A temperature sensing device can be attached in a similar fashion. The device can be a resistive thermally varying trace (RTD) or thermocouple. The resistive trace and RTD can be coated with dielectric coating. The design should ensure that electrical contact is possible with the resistive trace and RTD trace. The entire assembly, including both sides, can be coated with conductive material, ensuring no electrical contact occurs between the conductive coating and either heater trace or RTD trace.

In another example, in some embodiments, a method of assembly of an ion lens assembly according to the present teachings can comprise providing a two piece ceramic lens. Lens pieces can be square or round, or other suitable shape, with an aperture of appropriate dimension in an appropriate location. The resistive trace can be attached to one ceramic lens. The resistive trace can be glued, deposited using physical deposition processes or printed using appropriate processes as known in the art. A temperature sensing device can be attached in a similar fashion. The device can be a resistive thermally varying trace (RTD) or thermocouple. The second piece of ceramic lens can be fastened to the first lens piece, which has a resistive trace and RTD attached. Fastening can be achieved via adhesive, screws, clamps or other suitable techniques as known in the art. The entire assembly can be coated with conductive material, ensuring that the resistive trace and RTD are not electrically attached to the conductive coating. The design should ensure that electrical contact is possible with the resistive trace and the RTD trace.

In another example, in some embodiments, a method of assembly of an ion lens assembly according to the present teachings can comprise providing a printed circuit board (PCB) lens. The lens can be a square or circular, or other suitable shape, flat PCB with an appropriately dimensioned aperture suitable for passing ions through. The PCB lens can be a multi-layer PCB where an internal circuit can be created with the required resistance to be used as a heater. The PCB lens can comprise a RTD device or thermocouple for sensing temperature. The PCB lens can be plated with a conductor. Electrical contact between the external plating and the internal resistive trace is not desirable. The design should ensure that electrical contact is possible with the resistive trace and the RTD trace.

In some embodiments, the fabrication method can further include providing one or more fluid channels in the heating element that allow the flow of a fluid, for example, a preheated liquid, through the heating element.

In some embodiments, the temperature of the ion lens assembly can be controlled for example, by using a temperature sensor and a feedback circuitry that is in communication with the temperature sensor and a voltage source that applies a voltage to a heating element incorporated in the ion lens assembly. The feedback circuitry (which can be incorporated in a controller) can receive temperature data from the temperature sensor and can adjust the voltage (power) applied to the temperature sensor so as to maintain the temperature of the ion lens assembly (or at least a portion thereof) within a desired temperature range, for example, in a range of about 100° C. to about 300° C.

Further understanding of various aspects of the present invention can be obtained by reference to the following detailed description in conjunction with the associated drawings, which are described briefly below.

BRIEF DESCRIPTION OF THE DRAWINGS

FIG. 21 at panel (A) depicts images of water droplets on an exposed surface of an ion lens assembly according to the present teachings following operation of the ion lens assembly when the ion lens assembly was heated (the inset shows water droplets on a conventional lens after the same operating conditions). FIG. 21 at panel (B) depicts a schematic diagram illustrating a method for determining the contact angle of a water droplet on a surface.

DEFINITIONS

Figure 1:
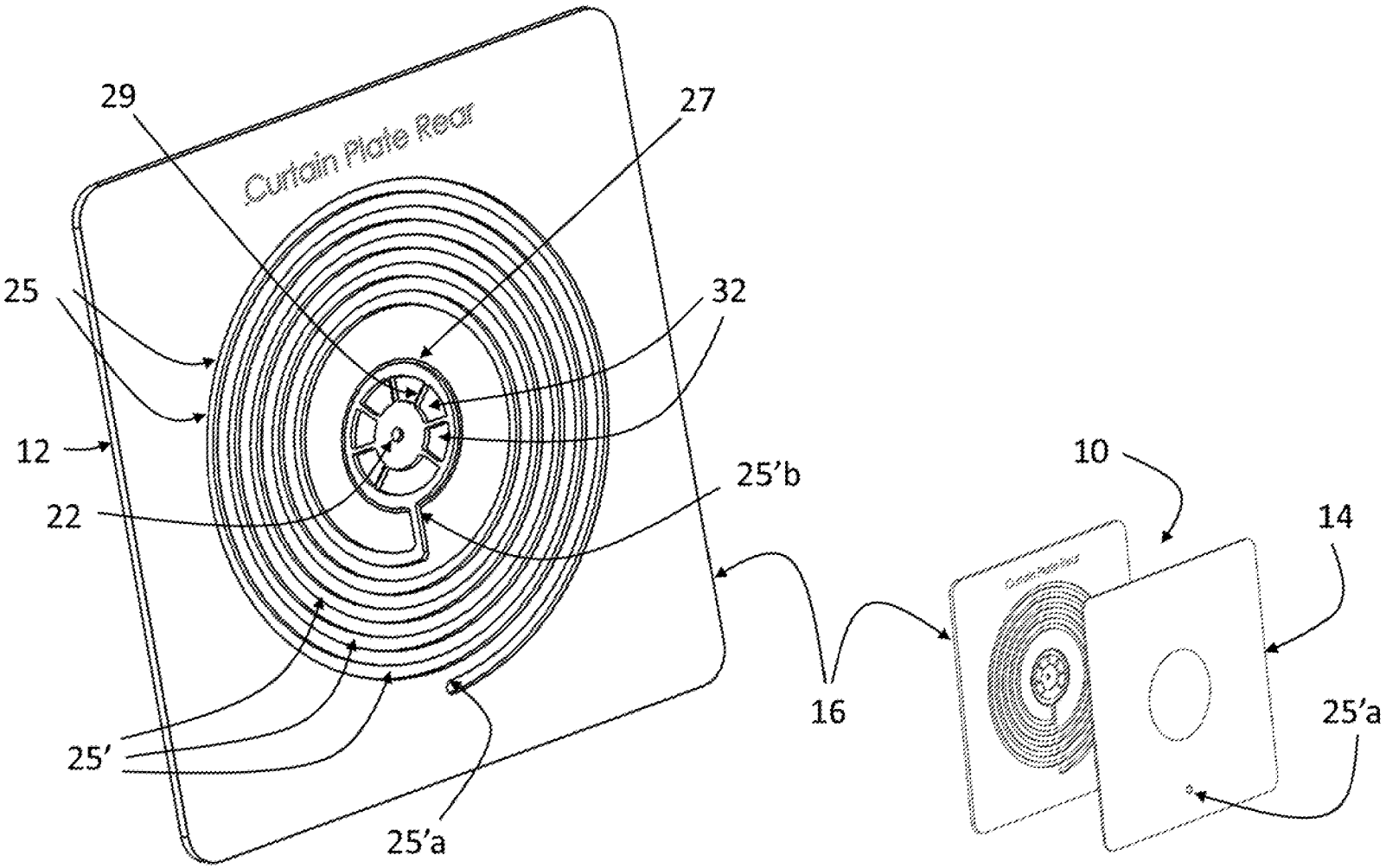
FIG. 1 schematically depicts a curtain plate/orifice assembly having a curtain plate and an orifice plate (the plates are shown in a non-assembled configuration for ease of description) according to an embodiment of the present teachings, FIG. 2A schematically depicts the front surface of a curtain plate according to an embodiment of the present teachings.

In order for the present disclosure to be more readily understood, certain terms are first defined below. Additional definitions for the following terms and other terms are set forth throughout the specification.

As used herein, the terms "about" and "approximately" are used as equivalents. Any numerals used in this application with or without about/approximately are meant to cover any normal fluctuations appreciated by one of ordinary skill in the relevant art. In certain embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

As used herein, unless otherwise clear from context, the term "a" may be understood to mean "at least one." As used in this application, the term "or" may be understood to mean "and/or." In this application, the terms "comprising" and "including" may be understood to encompass itemized components or steps whether presented by themselves or together with one or more additional components or steps.

"Substantially": As used herein, the term "substantially," and grammatical equivalents, refer to the qualitative condition of exhibiting total or near-total extent or degree of a characteristic or property of interest. One of ordinary skill in the art will understand that biological and chemical phenomena rarely, if ever, go to completion and/or proceed to completeness or achieve or avoid an absolute result.

It will be appreciated that for clarity, the following discussion will explicate various aspects of embodiments of the applicant's teachings, while omitting certain specific details wherever convenient or appropriate to do so. For example, discussion of like or analogous features in alternative embodiments may be somewhat abbreviated. Well-known ideas or concepts may also for brevity not be discussed in any great detail. The skilled person will recognize that some embodiments of the applicant's teachings may not require certain of the specifically described details in every implementation, which are set forth herein only to provide a thorough understanding of the embodiments. Similarly, it will be apparent that the described embodiments may be susceptible to alteration or variation according to common general knowledge without departing from the scope of the disclosure. The following detailed description of embodiments is not to be regarded as limiting the scope of the applicant's teachings in any manner.

DETAILED DESCRIPTION

With reference to FIGS. 1, 2A, 2B, 2C, 3A and 3B, an integrated curtain plate/orifice plate assembly 10 for use in a mass spectrometric system is disclosed, which includes a curtain plate 12 that is coupled to an orifice plate 14. The curtain plate 12 includes a printed circuit board (PCB) 16 having a front surface 18, which faces the incoming ions (not shown in these figures), and an opposed back surface 20. The printed circuit board 16 includes a central aperture 22 that extends from the front surface 18 to the back surface 20 for receiving ions from an upstream ion source of a mass spectrometer in which the integrated curtain plate/orifice plate assembly 10 is incorporated. The shape and/or the size of the aperture can be selected based on an intended application of the integrated curtain plate/orifice plate assembly. By way of example, the aperture of the curtain plate can be circular with a diameter, for example, in a range of about 1 to about 6 mm. Further, in some embodiments, the aperture (orifice) of the orifice plate can be circular with a diameter, for example, in a range of about 100 microns (μm) to about 2 millimeters (mm).

Each of the curtain plate and the orifice plate is formed of a printed circuit board (PCB) having at least a metalized surface that allows application of a desired voltage thereto. By way of example, the PCB employed to fabricate any of the curtain plate or the orifice plate can be made of suitable polymeric materials, such as RO4350B laminate material marketed by Rogers Corporation, U.S.A., which includes glass reinforced hydrocarbon/ceramics. A variety of different metals can be employed for metalizing the PCB, where typically gold-plated copper is employed, as discussed herein.

With particular reference to FIGS. 1 and 2A-2C, the front surface 18 of the curtain plate 12 includes a disk-shaped metal coating 24 disposed thereon, which surrounds the central aperture 22. In this embodiment, the metal coating is formed of gold-plated copper, though other metals, can also be employed. In general, the metal should be selected so as to minimize, and preferably eliminate, its reaction with ions passing through the integrated curtain plate/orifice plate assembly.

The opposed back surface 20 includes a plurality of channels 25, which provide passageways for gas flow. More specifically, in this embodiment, the channels 25 include a peripheral spiral-shaped channel 25' that can receive a supply of gas at its inlet port 25'*a*. The spiral channel is coupled at its outlet 25'*b* to a circular channel 27, which in turn communicates with a plurality of radial channels 29 that extend towards the central aperture 22 of the curtain plate 12.

A metal coating 28 covers the exposed surfaces of the channels 25, including the bottom and the side surfaces of the channels 25, and the top surfaces of the wedge-shaped portions 32 disposed between the radial channels 29. Similar to the metal coating 24 disposed on the front surface 18, in this embodiment, the metal coating 28 is formed of gold-plated copper, though other metals, such as those listed above, can also be used.

Figure 2A:
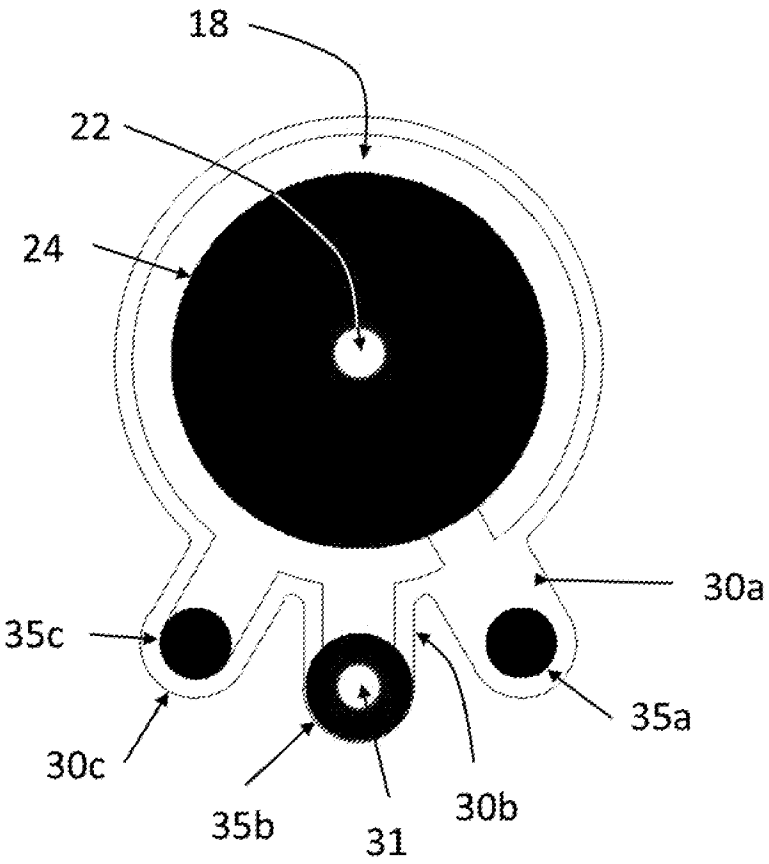
FIGS. 2B and 2C depict two schematic views of the back surface of the curtain plate for demonstrating the pattern of metalization applied to the back surface according to an embodiment of the present teachings, FIG. 3A schematically depicts the front surface of the orifice plate according to an embodiment of the present teachings, FIG. 3B schematically depicts the back surface of the orifice plate according to an embodiment of the present teachings, FIG. 4A schematically depicts that any of the curtain plate or the orifice plate according to some embodiments can have a substantially square shape, FIG. 4B schematically depicts that any of the curtain plate or the orifice plate according to some embodiments can have a disk-like portion from which a plurality of fingers radially extend, FIG. 4C schematically depicts that any of the curtain plate or the orifice plate according to some embodiments can have a disk-like shape with no radially-extending fingers, FIGS. 5A and 5B schematically depict a curtain plate/orifice plate assembly in which a resistive heating element is disposed on a surface of the orifice plate according to an embodiment of the present teachings, FIG. 6 schematically depicts a mass spectrometer in which a curtain plate/orifice plate according to an embodiment of the present teachings is incorporated.
Figure 2B:
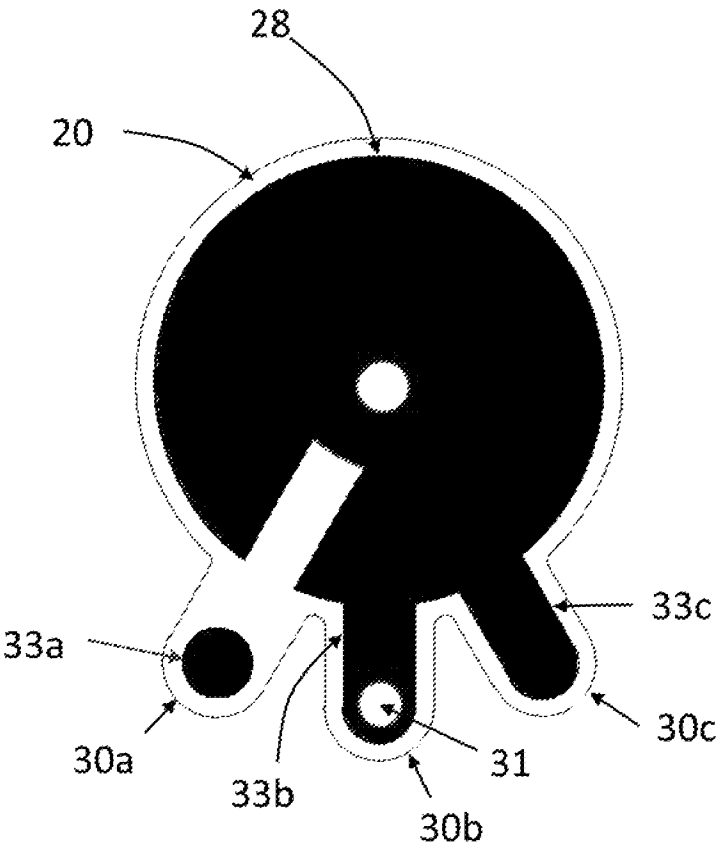
Figure 2C:
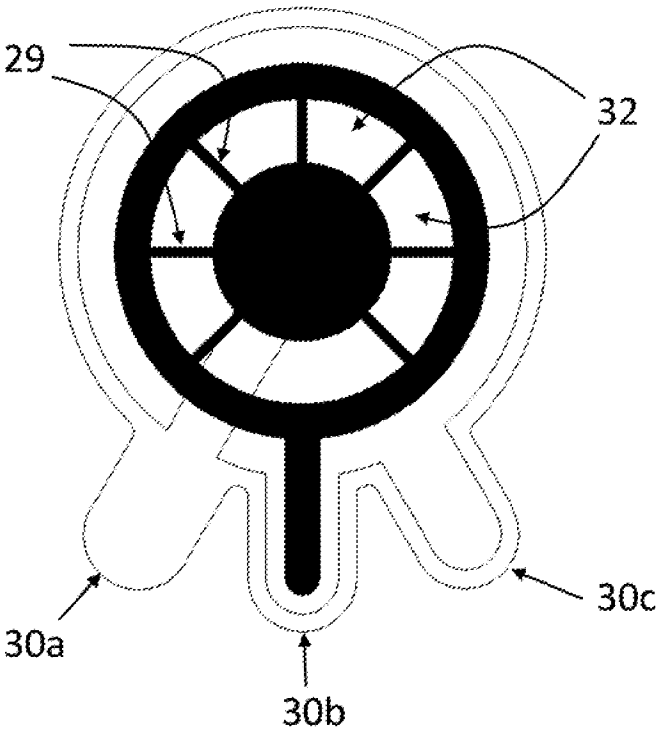

With continued reference to FIGS. 2A-2C, in this embodiment, the curtain plate 12 is in the shape of a disk with a plurality of radially-extending fingers 30*a*, 30*b*, and 30*c*. The fingers 30*a*, 30*b*, and 30*c* are metalized in a manner discussed below to allow the application of a voltage to metalized portions of the curtain plate. More specifically, in this embodiment, the fingers 30*b* and 30*c* have metal coating 33*b* and 33*c*, respectively, disposed on back surfaces thereof, where the metal coatings 33*b* and 33*c* are electrically coupled to the metal coating 28 disposed on the back surface of the curtain plate to allow the application of an electrical voltage thereto. The fingers 30*b* and 30*c* have, respectively, metal portions 35*b* and 35*c* disposed on their front surfaces, wherein metal portions 35*b* and 35*c* are electrically connected, through a via in the PCB (not shown in the figures), to the back metal coatings 33*b* and 33*c*. The finger 30*a* includes a metal portion 35*a* disposed on its front surface, which is electrically coupled to a metal portion 33*a* disposed on its back surface through a via in the PCB (not shown in the figures).

In some embodiments, a voltage in a range of, e.g., −800 volts (DC) to about +800 volts (DC), can be applied to the curtain plate. The sign of the voltage can be positive or negative depending on the charge of the ions that are processed by a mass spectrometer in which the integrated orifice plate/curtain plate assembly is incorporated. By way of example, when the spectrometer is operating in a positive ion mode, the voltage applied to the curtain plate is positive to form a gradient in the interface between the curtain and the orifice plates.

In this embodiment, the radially-extending finger 30*b* includes an inlet port 31 through which a gas can be introduced to the gas flow channels 25. When the curtain plate is coupled to the orifice plate, the channels 25 facilitate flow of the gas between the two plates with the gas exiting through the central aperture 22 of the curtain plate.

Figure 3A:
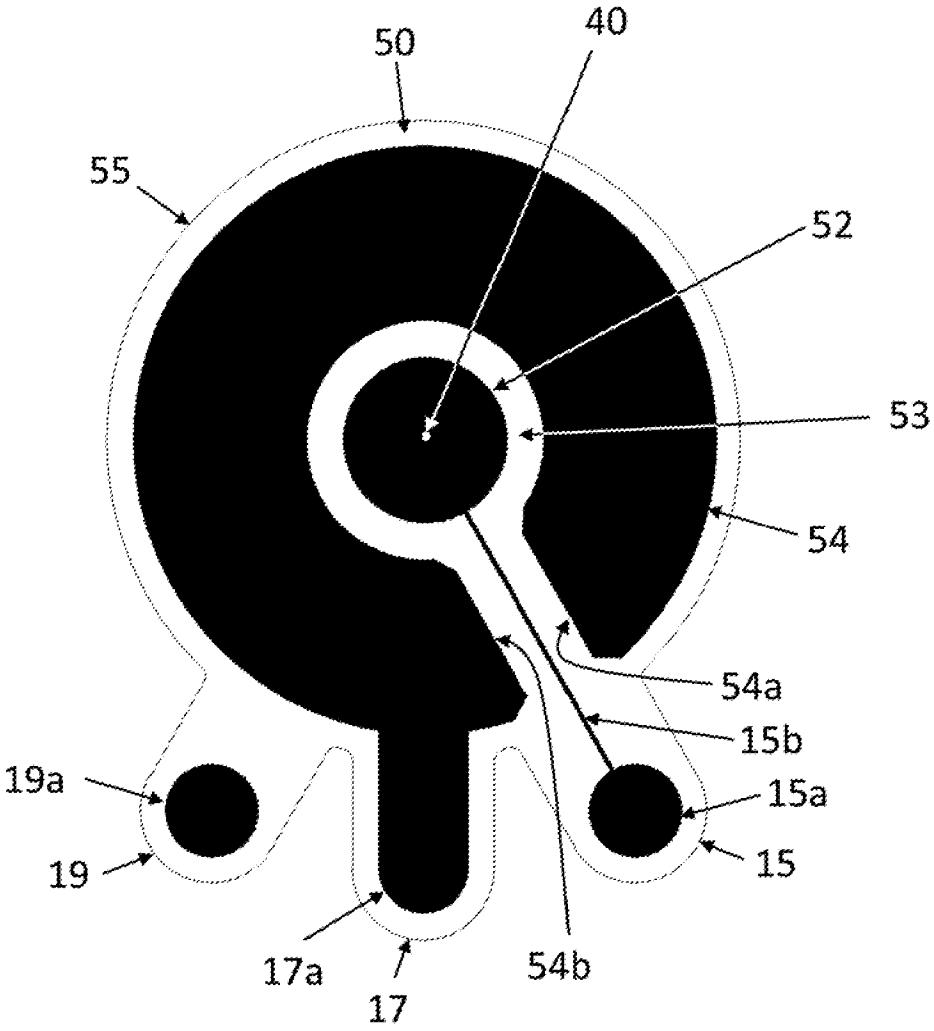
Figure 3B:
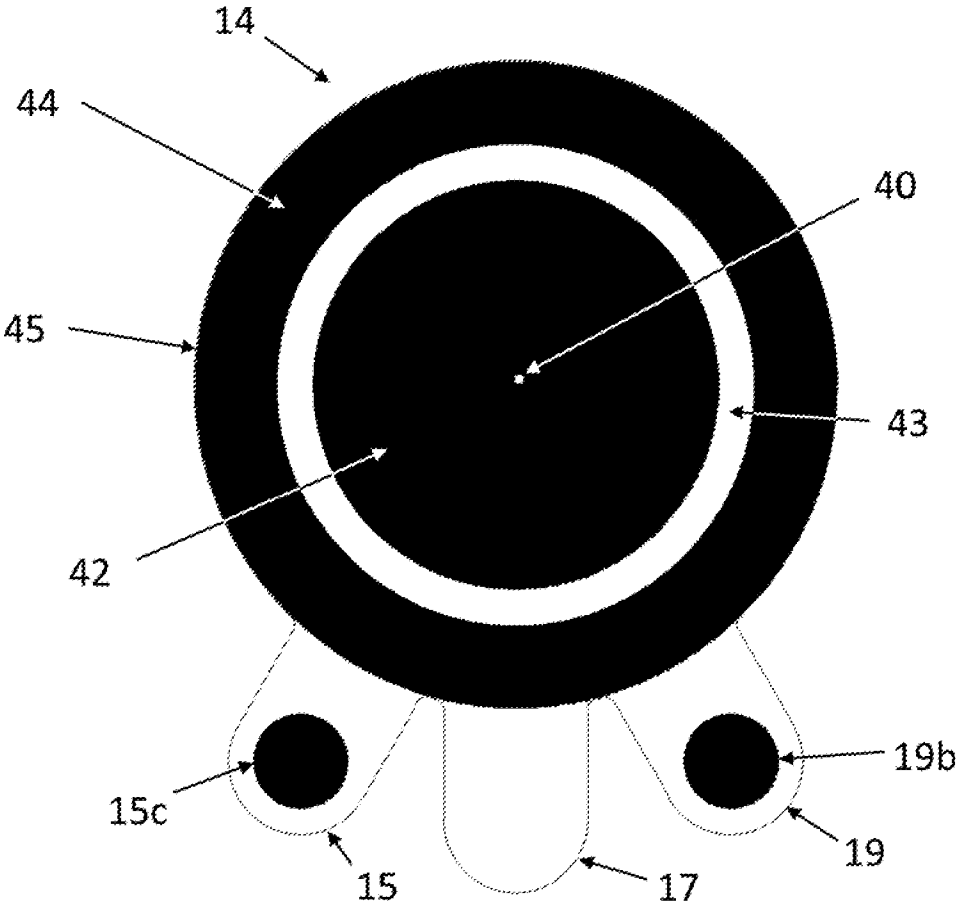

With reference to FIGS. 3A and 3B, the orifice plate 14 is in the form of a disk from which three fingers 15, 17, and 19 extend. Similar to the curtain plate 12, the orifice plate 14 is formed of a printed circuit board (PCB) whose front and rear surfaces are metalized in a manner discussed below. The orifice plate 14 includes a central aperture 40 (herein also referred to as orifice or central orifice) that is substantially aligned with the central aperture 22 of the curtain plate when the curtain plate and the orifice plate are assembled. The ions that enter the curtain plate via its central aperture 22 exit the curtain plate/orifice plate assembly via the aperture 40 of the orifice plate to be introduced into one or more downstream analyzers of a mass spectrometer, as discussed in more detail below.

Referring to FIG. 3A, the front surface 50 of the orifice plate 14 (i.e., the surface that faces the back surface of the curtain plate) is metalized. In particular, a central disk-shaped metal coating 52 surrounds the aperture 40 of the orifice plate. A peripheral metal coating 54 in the form of a truncated annular metal coating is radially separated from the central metal coating 52 by an unmetalized circular portion 53 of the PCB and is hence electrically insulated from the peripheral metal coating 54. The peripheral coating 54 circles partially around the central aperture 52, extending between two ends 54*a* and 54*b*. Further, an unmetalized portion 55 of the PCB surrounds the metalized portions 52 and 54.

Referring to FIG. 3B, a central metal portion 42 and a peripheral metal portion 44 are disposed on a rear surface 45 of the orifice plate, i.e., the surface that faces the downstream components of a mass spectrometer in which the integrated curtain plate/orifice plate assembly is incorporated. The central metal portion 42 is in the form of a disk-shaped metal coating that fully surrounds the central aperture 40 of the orifice plate and extends through the PCB to the metal portion 52 on the front surface of the orifice plate such that the metal portions 42 and 52 form one contiguous metal segment to which a voltage can be applied. The peripheral metal portion 44 is in the form of an annular ring and is radially separated from the central metal portion 42 and is electrically insulated therefrom by a circular, unmetallized portion 43 of the PCB.

With continued reference to FIGS. 3A and 3B, the fingers 15, 17, and 19 are metalized in a manner discussed below to allow the application of a voltage to at least some of the metal coatings disposed on the front and/or back surfaces of the orifice plate. In particular, a metal portion 15*a* is disposed on the front surface of the finger 15. A metal strip 15*b* traverses between the two ends 54*a* and 54*b* of the peripheral metal coating 54 to electrically connect the metal portion 15*a* to the central disk-like metal coating 52. The rear surface of the finger 15 includes a metal portion 15*c*, which is electrically connected to the metal portion 15*a* through a via (not seen in these figures) extending between the front and the back surfaces of the finger 15. Thus, the central disk-like metal coating 52 can be coupled to a voltage source via the metalized finger 15.

Referring to FIG. 3A, the finger 17 also includes a metal coating 17*a* on a front surface thereof, which extends from a distal end of the finger to the peripheral metal coating 54 and hence allows the application of a voltage thereto. The back surface of the finger 17 is not, however, metalized. The metal coating 17*a* is in electrical contact with the metal coating of finger 30*b* and both 33*b* and 33*c* of the curtain plate (see, FIGS. 3A and 3B) such that a voltage can be applied via the metal coating of the finger 30*b* and both 33*b* and 33*c* to the metal coating 17*a*, and consequently to the metal coating 54. The finger 19 further includes a metal portion 19*a* on its front surface and a metal portion 19*b* on its back surface.

In some embodiments, a voltage in a range of about −300 volts (DC) to about +300 volts (DC) can be applied to the orifice plate. In such embodiments, the voltage applied to the orifice plate is selected such that a voltage differential established between the orifice plate and downstream ion optics can facilitate declustering of the ions as they move from atmospheric pressure to a vacuum.

Similar to the curtain plate, the metal coatings of the orifice plate can be formed of a variety of different metals. By way of example, in this embodiment, the metal coatings can be formed of gold-plated copper, though other suitable metals can also be employed. In general, the metal should be selected so as to minimize, and preferably eliminate, its reaction with ions passing through the integrated curtain plate/orifice plate assembly. Further, similar to the metal coatings of the curtain plate, the metal coatings of the orifice plate can have any suitable thickness. By way of example, in one embodiment in which the metal coating is formed by depositing a layer of nickel on copper and coating the nickel with gold, the copper layer can have, for example, a thickness of about 35 microns, and the thickness of the nickel layer can be, for example, in a range of about 3 microns to about 6 microns, and the thickness of the gold layer can be, for example, in a range of about 0.075 microns to about 0.125 microns.

The curtain plate and the orifice plate can be coupled to one another in a variety of different ways. By way of example, the curtain plate can be fused or bonded to the orifice plate. Alternatively, or in addition, a plurality of fasteners can be employed to couple the curtain plate to the orifice plate.

Figure 4C:
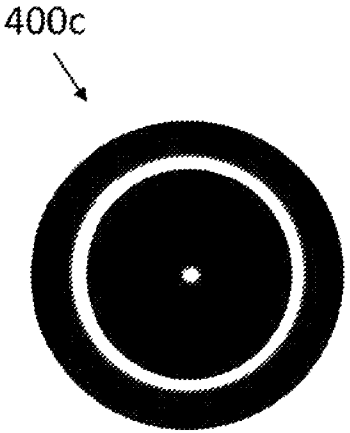
Figure 4B:
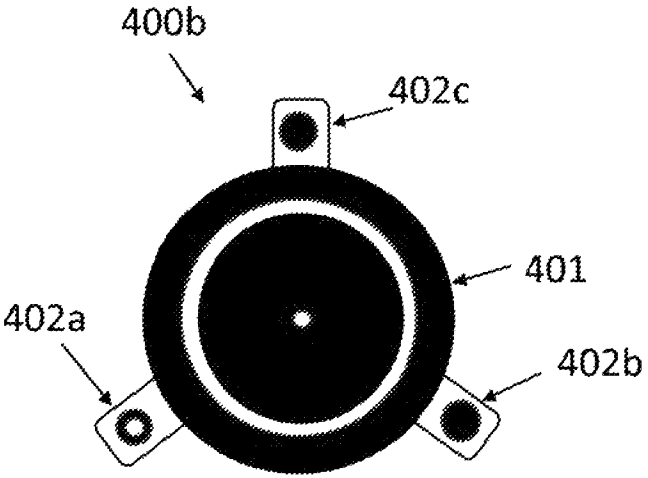
Figure 4A:
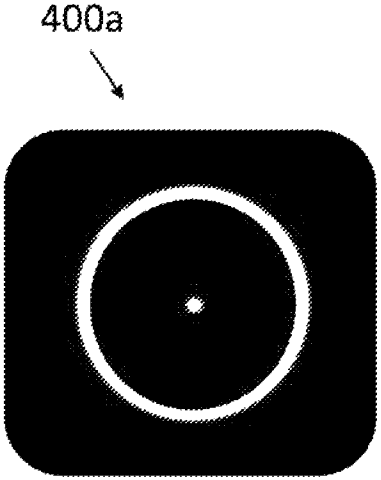

The curtain plate and/or the orifice plate can have a variety of different shapes and configurations. By way of example, as shown in FIG. 4A, in some embodiments, a curtain plate or an orifice plate 400*a* can have a substantially square shape. FIG. 4B schematically depicts that in another embodiment, a curtain plate or an orifice plate 400*b* can have a disk-like portion 401 and three fingers 402*a*/402*b*/402*c* that are distributed around the perimeter of the disk-like portion. In this embodiment, the angular separations between the fingers are substantially uniform. In yet another embodiment, as shown schematically in FIG. 4C, a curtain plate or an orifice plate 400*c* can have a substantially circular shape without any fingers. Other shapes and configurations can also be employed, e.g., depending on a particular application.

Figure 5A:
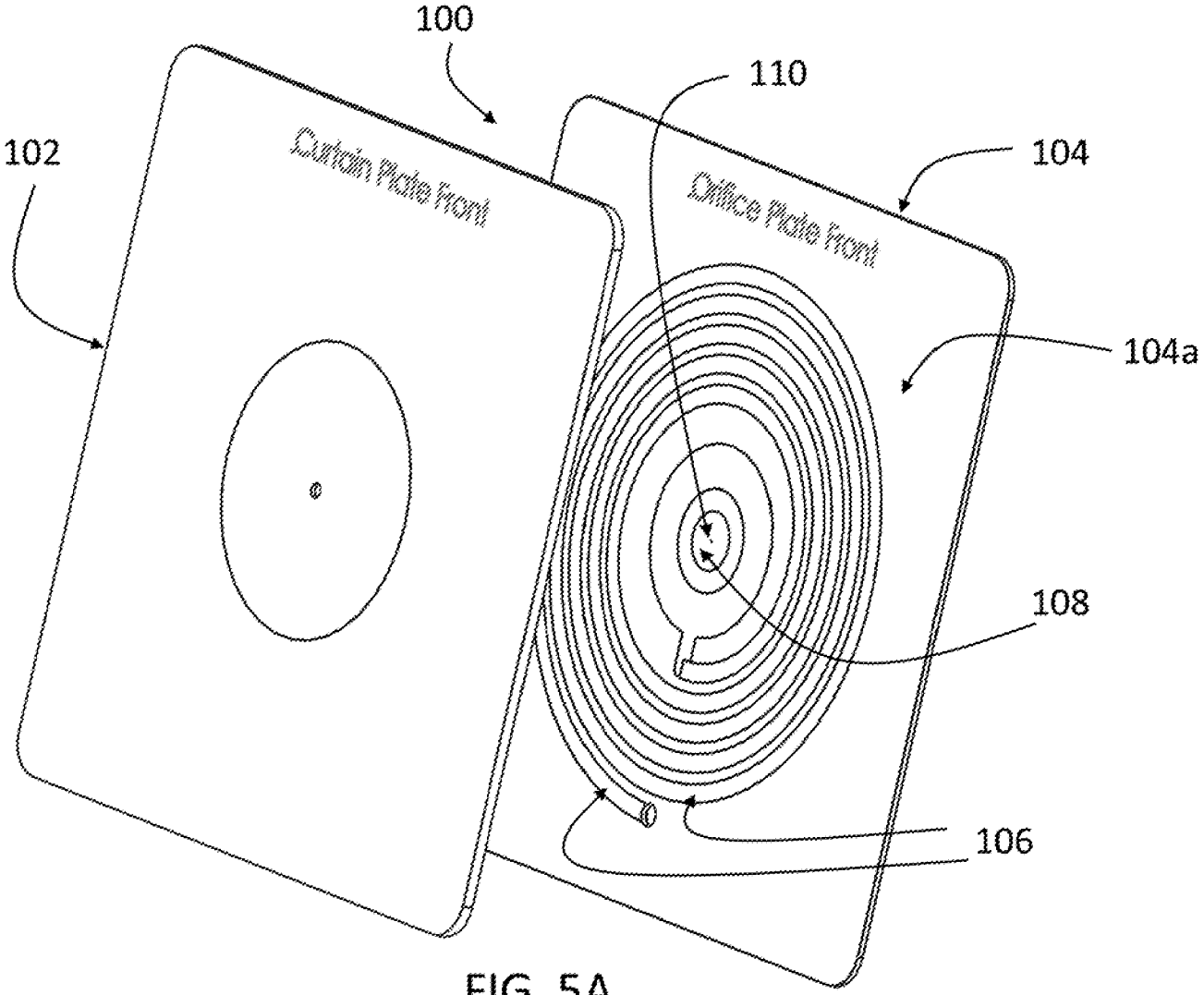
Figure 5B:
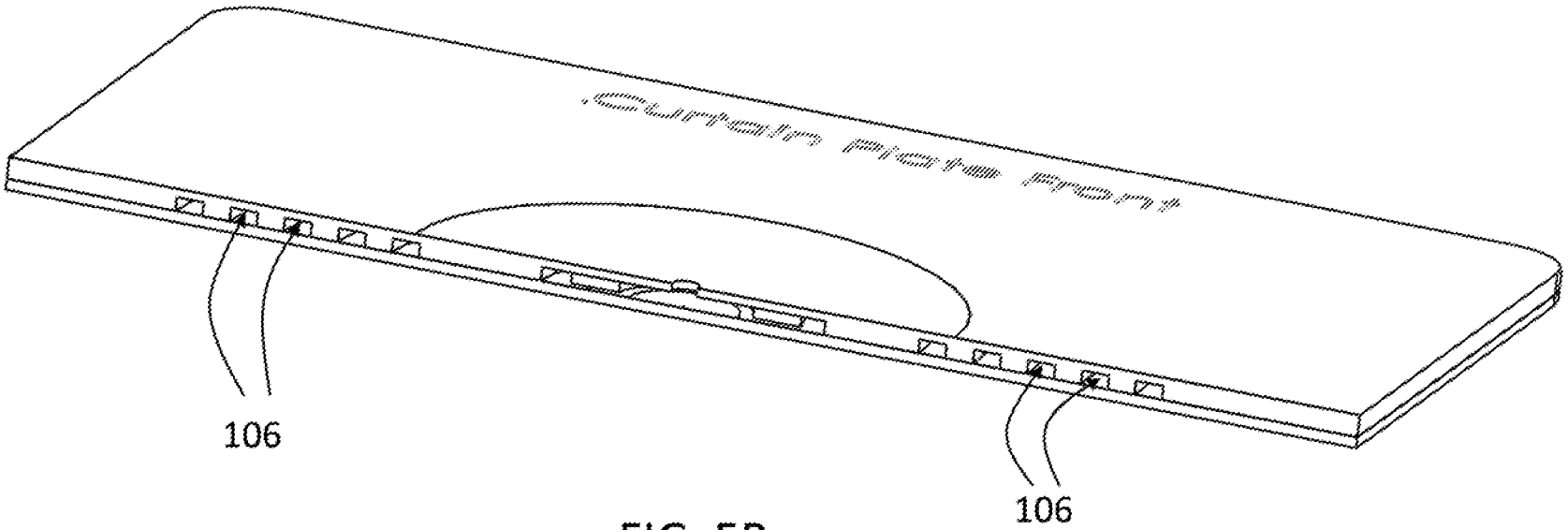

In some embodiments, the orifice plate can include a heating element. By way of example, FIGS. 5A and 5B schematically depict a curtain plate/orifice plate assembly 100, which includes a curtain plate 102 and an orifice plate 104. Similar to the previous embodiments, the orifice plate and the curtain plate can be coupled to one another to form an integrated curtain plate/orifice plate assembly. The curtain plate 102 and the orifice plate 104 are configured similarly to the curtain plate 12 and the orifice plate 14 discussed above. However, in this embodiment, the orifice plate 104 includes a resistive heating element 106 disposed on a front surface 104*a* thereof (i.e., the surface facing the curtain plate). The application of a voltage to the resistive element 106 can cause heating thereof, thereby heating a gas flowing in the space between the orifice plate and the curtain plate. In this embodiment, the resistive heating element surrounds a disk-like metal coating 108, which surrounds an orifice 110 of the orifice plate. The back surface of the orifice plate 104 can have a pattern of metalization similar to that described above in connection with the orifice plate 14.

A curtain plate and an orifice plate according to the present teachings can be fabricated using methods known in the art. For example, a PCB board can be obtained from a variety of different manufacturers. A desired pattern of metalization can be deposited on the front and/or back surface of the PCB board using standard techniques known to those having ordinary skill in the art.

Figure 6:
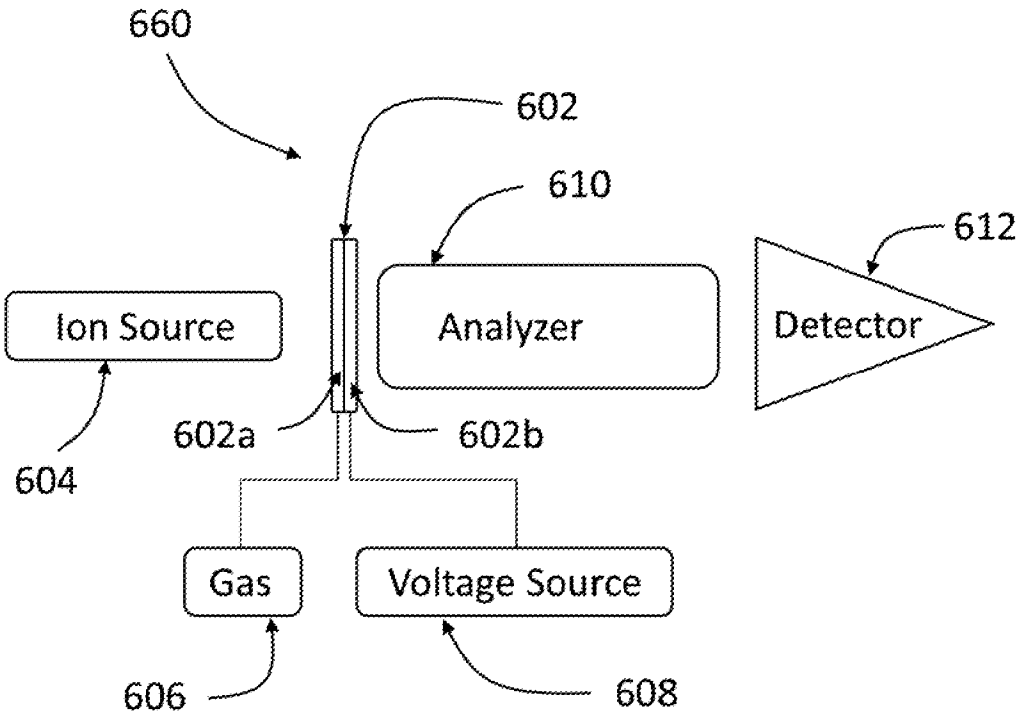

As noted above, a curtain plate/orifice plate assembly according to the present teachings can be employed in a variety of different mass spectrometers. By way of example, FIG. 6 schematically depicts a mass spectrometer 660 in which an integrated curtain plate/orifice plate assembly 602 according to the present teachings is incorporated. The curtain plate/orifice plate assembly 602 includes a curtain plate 602*a* and an orifice plate 602*b*, such as those discussed above, which are coupled to one another to form the assembly. The exemplary mass spectrometer 660 further includes an ion source 604 that is configured to generate ions, which are received by the assembly 602 via the aperture of the curtain plate 602*a*, such as the above aperture 22. A source of a gas 606, such as nitrogen, is coupled to the gas input port of the curtain plate to introduce a gas flow in the space between the curtain plate and the orifice plate, which is provided by the channels in the curtain plate. As discussed above, the gas flow exits the assembly 602 via the aperture of the curtain plate in a direction substantially opposite to the direction along which the ions enter the assembly. The gas flow out of the aperture of the curtain plate can advantageously reduce, and preferably prevent, neutral species or other contaminants from entering the curtain plate/orifice plate assembly, and consequently the downstream components of the mass spectrometer.

A voltage source 608 applies selected voltages to the curtain plate and the orifice plate, e.g., in a manner discussed above. The voltages applied to the curtain plate and the orifice plate help attract the ions to the curtain plate/orifice plate assembly and facilitate their passage through the assembly. Commonly, for positive ion generation, the electrospray emitter is held at about 2000V-5000V, the curtain plate at about 200V-1000V, and the orifice plate at 10V-150V in order to facilitate the passage of the ions through the curtain plate/orifice plate assembly.

In this embodiment, the ions exiting the curtain plate/orifice plate assembly enter a downstream mass analyzer 610, which can analyze the ions based on their mass-to-charge (m/z) ratios. The ions passing through the mass analyzer can be detected by an ion detector 612. A variety of mass analyzers and ion detectors can be employed. For example, the mass analyzer 610 can be one or more quadrupole analyzers, time-of-flight analyzers, differential ion mobility analyzers, among others. Further the ion detector can be, for example, any combination of electron multiplier/electron multiplier-HED or other suitable detectors. In some embodiments, the analyzer 610 is a tandem mass analyzer that provides multiple stages of mass analysis. By way of example, the mass analyzer 610 can be an MS/MS analyzer having two quadrupole mass analyzers and a collision cell disposed between these two quadrupole mass analyzers. In some embodiments, such an MS/NIS analyzer can be operated in a multiple reaction monitoring (MRM) mode. For example, in such a mode, the first quadrupole analyzer can be configured to select precursor ions within a specified range of m/z ratios. The selected precursor ions can enter the collision cell and be fragmented due to collisions with a background gas. The second quadrupole analyzer can be configured to select fragment ions within a specified range of m/z ratios. In this manner, parent/daughter ion pairs can be selectively detected.

A curtain plate/orifice plate assembly according to the present teachings can provide a number of advantages. For example, it can be fabricated at a low cost while providing mass spectra having similar peak shapes and stability and/or sensitivity as the mass spectra obtained by using conventional curtain and orifice plates. In some cases, a curtain plate/orifice plate assembly according to the present teachings can be used as a disposable item. For example, rather than cleaning the curtain plate/orifice plate assembly after one or more runs of the spectrometer, a curtain plate/orifice plate assembly according to the present teachings can be discarded and a new assembly can be used.

The following example is provided for further illustration of various aspects of the present invention, and is not intended to indicate necessarily the optimal ways of practicing the invention or optimal results that can be obtained.

Example

A prototype curtain plate/orifice plate assembly based on the design discussed above in connection with the assembly 10 was fabricated. The prototype assembly was incorporated in a triple quadrupole mass spectrometer. The mass spectrometer was used to obtain the mass spectrum of Reserpine. For comparison purposes, the mass spectrum of Reserpine was also obtained using the same mass spectrometer but with a conventional metal conical curtain plate and a standard orifice plate. The same processing parameters were employed in both cases to obtain the respective mass spectra.

Figure 7:
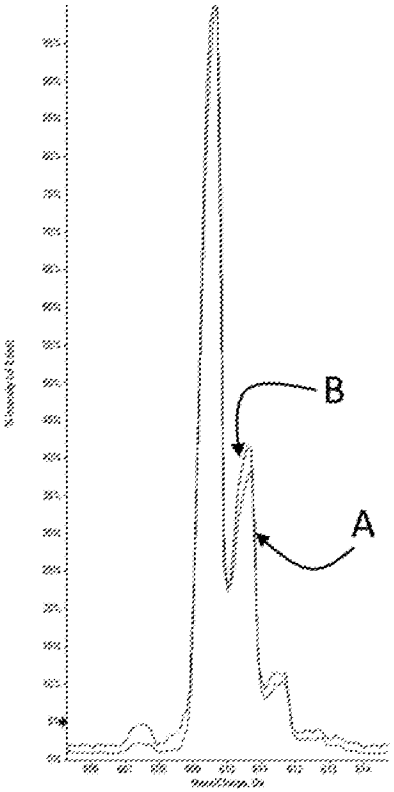
FIG. 7 shows mass spectra obtained using standard curtain plate/orifice plate assembly and using a curtain plate/orifice plate assembly according to an embodiment of the present teachings.

FIG. 7 depicts the obtained mass spectra using a prototype curtain plate/orifice plate assembly according to the present teachings and using conventional curtain and orifice plates. In particular, the mass spectrum labeled A was obtained using conventional curtain and orifice plates and the mass spectrum labeled B was obtained using a curtain plate/orifice plate assembly according to the present teachings.

A comparison of the mass spectra shows that the use of a curtain plate/orifice plate assembly according to the present teachings results in peak shapes and stability comparable to those obtained using standard curtain and orifice plates. However, as noted above, a curtain plate/orifice plate assembly according to the present teachings can be fabricated at a much lower cost.

Furthermore, ionization at atmospheric pressure is generally a highly efficient means of ionizing molecules within a sample. Examples of atmospheric pressure ionization include, for example, chemical ionization, electrospray ionization, photoionization, etc. Atmospheric pressure ionization can generate ions of analytes of interest, as well as interfering/contaminating ions and neutral molecules in high abundance. The present disclosure encompasses a recognition that from an analytical perspective it may be desirable to maximize the number of ions of interest entering an ion guide and thereby potentially increasing the sensitivity of a mass spectrometry system. Such maximization can, however, result in unwanted molecules entering downstream vacuum chambers and potentially downstream mass analyzer stages.

Transmission and trajectories of ions of interest are precisely controlled by electric fields. However, transmission of other molecules located inside high-vacuum chambers, such as undesired ions and neutral molecules, can foul/contaminate these downstream elements.

Regions near an aperture of an ion lens become sensitive to contamination. Ions approaching an aperture generally have a relatively low kinetic energy, for example, on the order of a volt per unit charge. A contaminated surface near the aperture of an ion lens can have, for example, an electrical potential of at least about a volt or higher, which can alter ion trajectories and thus lead to diminished performance of the mass spectrometry system.

Depositing ions on the lens surface or contamination of the lens can interfere with mass spectrometric analysis and/or leading to increased costs or decreased throughput as a result of the need for cleaning of critical components within the high-vacuum chamber(s). The deposition of ions and possibly neutral species on surfaces of ion lenses can contaminate the lenses and can cause a drop in performance of the mass spectrometry system.

Diminished performance can manifest itself, for example, in a reduction in ion transmission or the ion space velocity correlation changes, which can lead to a drop in resolution or a change in channeling alignment. Because of higher sample loads and contaminating nature of the biologically-based samples being analyzed with current day atmospheric pressure ionization sources, maintaining a clean mass analyzer remains a critical concern.

The present disclosure encompasses a recognition that in mass spectrometry systems contamination from ions and neutral species that can impinge on surfaces of such mass spectrometry systems can hinder transmission of ions and/or operation of mass spectrometry systems in a variety of different ways. Lenses are used to create electric fields. For this purpose, they are composed of conductive material so that the voltage on the surfaces can be controlled. When they become contaminated, and the contamination material is not conductive, the surface may assume an unknown uncontrolled voltage, and the ion behaviour cannot be controlled or predicted. Ions will not go where they were intended to, and are lost. Thus, contamination from deposits on ion lenses can cause diminished performance in mass spectrometry systems. The present disclosure further encompasses a recognition that there is a need in mass spectrometry systems for ion lenses that are configured to control, inhibit, and/or reduce contamination and/or deposits from ions and/or neutral species that can impinge on lens surfaces.

Among other things, in some embodiments, the present disclosure includes an ion lens assembly for use in a mass spectrometry system. In some embodiments, an ion lens assembly of the present disclosure is configured to direct transmission and/or trajectory of ions of interest using electric fields while controlling, inhibiting, and/or reducing contamination and/or deposits from ions and/or neutral species that impinge on lens surfaces. In some embodiments, the present disclosure provides a mass spectrometry system that can include an ion source for generating ions and one or more components, such as ion guide chambers, filters, collision cells, etc., that are positioned downstream from the ion source for receiving ions. In some embodiments, such downstream components can include an inlet orifice for receiving ions generated from the ion source and at least one exit orifice for transmitting ions to a mass analyzer. In some embodiments, an ion lens assembly as disclosed herein can be positioned in proximity of any of an inlet port or an exit port of such downstream components, as discussed in more detail below.

In some embodiments, an ion lens assembly according to the present teachings can include a heating element incorporated therein to heat the ion lens assembly, and particularly those surfaces of the ion lens assembly that are exposed to ions. In some embodiment, such heating of these surface can raise their temperature to an elevated temperature, for example, a temperature in a range of about 100° C. to about 300° C., so as to reduce, or eliminate, the deposition of contaminants on those surfaces and/or cause such desorption of such contaminated deposits. In some such embodiments, a temperature sensor can also be incorporated into the ion lens assembly to measure the temperature of the assembly, or at least selected portions thereof. The measured temperature can be employed, together with a controller, to adjust a voltage applied to the heating element so as to maintain the temperature of the ion lens assembly within a desired range. The elevated temperature causes a change in the sticking coefficient making it significantly less likely that ion or neutral particles will remain on hot surfaces after impinging upon them.

In some embodiments, the ion lens assembly can include a plurality of layers, including a front cap layer having a forward surface that is arranged to face incoming ions, a rear layer, and a heating element disposed between the front cap layer and the rear layer. In some embodiments, each layer of the ion lens assembly can include an opening to allow passage of ions therethrough. The openings of the various layers are substantially aligned such that the ions can through the lens assembly, In some embodiments, apparatus, systems, and methods of the present disclosure are useful as a lens for directing and/or focusing ions of interest to a downstream mass analyzer and excluding unwanted ions and/or neutral species. In some embodiments, at least one lens employed in the mass spectrometry system is directly heated to an elevated temperature. For example, in some embodiments, at least one lens employed in the mass spectrometry system is directly heated to a temperature of about 100° C. to about 300° C., so as to control, inhibit, and/or reduce contamination and/or deposits from ions and/or neutral species that impinge on lens surfaces. In some embodiments, at least one ion lens can be formed and/in a way such that an electrical current can be caused to pass through at least a part of the lens so as to cause direct resistive heating of that part thereby raising the lens temperature. In some embodiments, the direct heating of the lens can raise its temperature value to a point at which the sticking coefficient for at least one lens surface for contamination by deposits from ions and/or neutral species is reduced or even eliminated. In some embodiments, the directly heated lens desorbs any prior contamination and/or deposits from ions and/or neutral species.

As noted above, in some embodiments, an ion lens assembly can include a plurality of layers. In some embodiments, the plurality of layers can include a number of different configurations. In some embodiments, the plurality of layers can include a front cap layer having a forward surface arranged to face incoming ions, a rear layer, and a heating element, such as a resistive heating element, that is disposed between the front cap layer and the rear layer. A plurality of substantially aligned openings in the front cap and rear layers and the heating element can allow passage of ions through the lens assembly.

In some embodiments, the front cap layer can include a forward surface that faces an incoming ion beam, and a backward surface that is in at least partial thermal contact with the heating element. Further, in such embodiments, the rear layer includes a forward surface that is in at least partial thermal contact with the heating element and an opposed backward surface that faces downstream components of the mass spectrometry system. The forward and backward surfaces of the front cap and rear layers can have a variety of different shapes and profiles. In some embodiments, one or more of such surfaces can have be substantially flat. Further, in some embodiments, such surfaces can have a circular, a square, a rectangular, or a polygonal shape, for example, pentagonal or hexagonal.

In some embodiments, at least a portion of any of the front or the rear layer of the ion lens assembly can be formed from a metal. By way of example, such a metal can be, without limitation aluminum, aluminum alloy(s), beryllium, brass, chromium, copper, gold, indium, iron, molybdenum, nickel, niobium, platinum, palladium, stainless steel(s), tantalum, titanium, tungsten, and/or zirconium.

In some embodiments, the front cap layer can be a discrete and/or separable element. That is, in some embodiments, for example, the front cap layer can be easily installed and/or removed. For example, in some embodiments, the front cap layer can be in the form of a coating or can be deposited on at least a portion of the heating element. In some embodiments, the front cap layer can be formed by depositing, for example, via electrodeposition, a metallic layer on a surface of an insulating layer that is mounted on the heating element. By way of example, the deposited metallic layer can have a thickness in a range of about 0.020 mm to about 1 mm. A variety of different metals can be employed. Some suitable metals include, without limitation, stainless steel, aluminum alloy, copper, molybdenum, conductive polymers, or carbon fibre. Any material with electrical conductivity sufficiently high to allow it to be held at a constant homogeneous voltage is a candidate material for this purpose.

In some embodiments, the rear layer of the ion lens assembly can be formed at least partially from a ceramic. In some embodiments, an ion lens assembly can be formed, for example, at least partially from a dielectric material, glass, plastic, ceramic, natural crystal, paper, natural or synthetic polymeric material, stone, and/or or non-conductive metal oxide film. In some embodiments, a ceramic can include, for example, aluminum oxide, aluminum nitride, beryllium oxide, silicon carbide, sapphire, silicon nitride, and/or zirconia.

In some embodiments, an ion lens assembly can be positioned in proximity of an inlet port of an ion guide chamber such that the ions exiting the ions lens assembly can enter the ion guide chamber via the inlet port. In some such embodiments, a mass analyzer can be disposed downstream of the ion guide chamber. As noted above, the front cap and rear layers, as well as the heating element can have a variety of shapes and sizes. In some embodiments, openings through the front cap and rear layers, as well as the heating element can have a variety of shapes and sizes. In some embodiments, one or more openings can be circular. In some such embodiments, the circular openings can have a radius of about 0.1 mm, about 0.15 mm, about 0.2 mm, about 0.25 mm, about 0.3 mm, about 0.35 mm, about 0.4 mm, about 0.45 mm, about 0.5 mm, about 0.55 mm, about 0.6 mm, about 0.65 mm, about 0.7 mm, about 0.75 mm, about 0.8 mm, about 0.85 mm, about 0.9 mm, about 1 mm, about 1.05 mm, about 1.1 mm, about 1.15 mm, about 1.2 mm, about 1.25 mm, about 1.3 mm, about 1.35 mm, about 1.4 mm, about 1.45 mm, about 1.5 mm, about 1.55 mm, about 1.6 mm, about 1.65 mm, about 1.7 mm, about 1.75 mm, about 1.8 mm, about 1.85 mm, about 1.9 mm, about 1.95 mm, or about 2 mm. In some embodiments, the openings can have other shapes.

In some embodiments, an attractive voltage can be applied to a front layer of an ion lens assembly, for example by coupling the rear layer to a power supply and/or a controller, for example, a direct current (dc) source. In some embodiments, such a voltage can be about 0.1 V, about 0.2 V, about 0.3 V, about 0.4 V, about 0.5 V, about 0.6 V, about 0.7 V, about 0.8 V, about 0.9 V, about 1 V, about 2 V, about 3 V, about 4 V, about 5 V, about 6 V, about 7 V, about 8 V, about 9 V, about 10 V, about 15 V, about 20 V, about 25 V, about 30 V, about 35 V, about 40 V, about 45 V, about 50 V, about 55 V, about 60 V, about 65 V, about 70 V, about 75 V, about 80 V, about 85 V, about 90 V, about 95 V, or about 100 V, or more.

In some embodiments, the ion lens assembly can be positioned relative to an incoming ion beam such that the forward surface of the ion beam assembly is positioned at an acute angle relative to the ion beam. In some embodiments, the angle is an angle relative to normal of the forward surface of the front cap layer. In some embodiments, such an angle is at least about 85°, at least about 86°, at least about 87°, at least about 88°, at least about 89°, at least about 90°, at least about 91°, at least about 92°, at least about 93°, at least about 94°, at least about 95°, at least about 96°, at least about 97°, at least about 98°, at least about 99°, or at least about 100°.

A variety of heating elements can be incorporated in the ion lens assembly. For example, in some embodiments, the heating element can be, for example, a ceramic heater, a cable and/or coil heater, a conduction heater, a fiber heater, a polyimide heater, a silicone rubber flexible heater, a thick film conduction heater, a thin film conduction heater, a thick film resistive heater, a thin film resistive heater, or a tubular heater. In some embodiments, the heating element can include one or more pins configured for coupling and/or connecting it to a power supply, controller, and/or driver.

In some embodiments, a heating element disposed between the front cap layer and the rear layer is configured to heat the layers to a temperature of at least about 50° C., 55° C., 60° C., 65° C., 70° C., 75° C., 80° C., 85° C., 90° C., 95° C., 100° C., 105° C., 110° C., 115° C., 120° C., 125° C., 130° C., 135° C., 140° C., 145° C., 150° C., 155° C., 160° C., 165° C., 170° C., 175° C., 180° C., 185° C., 190° C., 195° C., 200° C., 205° C., 210° C., 215° C., 220° C., 225° C., 230° C., 235° C., 240° C., 245° C., 250° C., 255° C., 260° C., 265° C., 270° C., 275° C., 280° C., 285° C., 290° C., 295° C., 300° C., or more.

In some embodiments, the temperature sensor can be resistance temperature detector (RTD). In some embodiments, the temperature sensor can be implemented as a resistive electrical trace to which a voltage can be applied for heating thereof. By way of example, the temperature sensor can also be a thermistor or a thermocouple.

In some embodiments, the temperature sensor can include one or more pins configured for coupling it to a power supply, controller, and/or driver. In some embodiments, the temperature sensor can be part of a feedback module that can be used to control the temperature of the ion lens assembly. For example, the temperature sensor coupled to the heating element can provide temperature data to a feedback circuitry (for example, a controller), which can in turn control the level of voltage applied by a voltage source to the heating element. For example, if the measured temperature is greater than a predetermined upper threshold, the feedback circuitry can cause the voltage source to reduce the voltage applied to the heating element, and if the measured temperature is less than a predetermined lower threshold, the feedback circuitry can cause the voltage source to increase the voltage applied to the heating element.

In some embodiments, the heating element is disposed between the front cap layer and the rear layer while the feedback circuitry is positioned external to the ion lens assembly for controlling the temperature of the ion lens assembly. In some embodiments, the heating element and/or the feedback circuitry are coupled to a power supply, controller, and/or driver.

In some embodiments, the plurality of layers can include an insulating layer disposed between the front cap layer and the heating element. For example, the insulating layer can be formed from a dielectric material, glass, plastic, ceramic, natural crystal, paper, natural or synthetic polymeric material, stone, and/or or non-conductive metal oxide film. In some embodiments, the insulating layer is formed of a dielectric material that exhibits good thermal conductance. Some examples of such materials include, without limitation, silicon nitride, alumina, diamond or mica.

Figure 8:
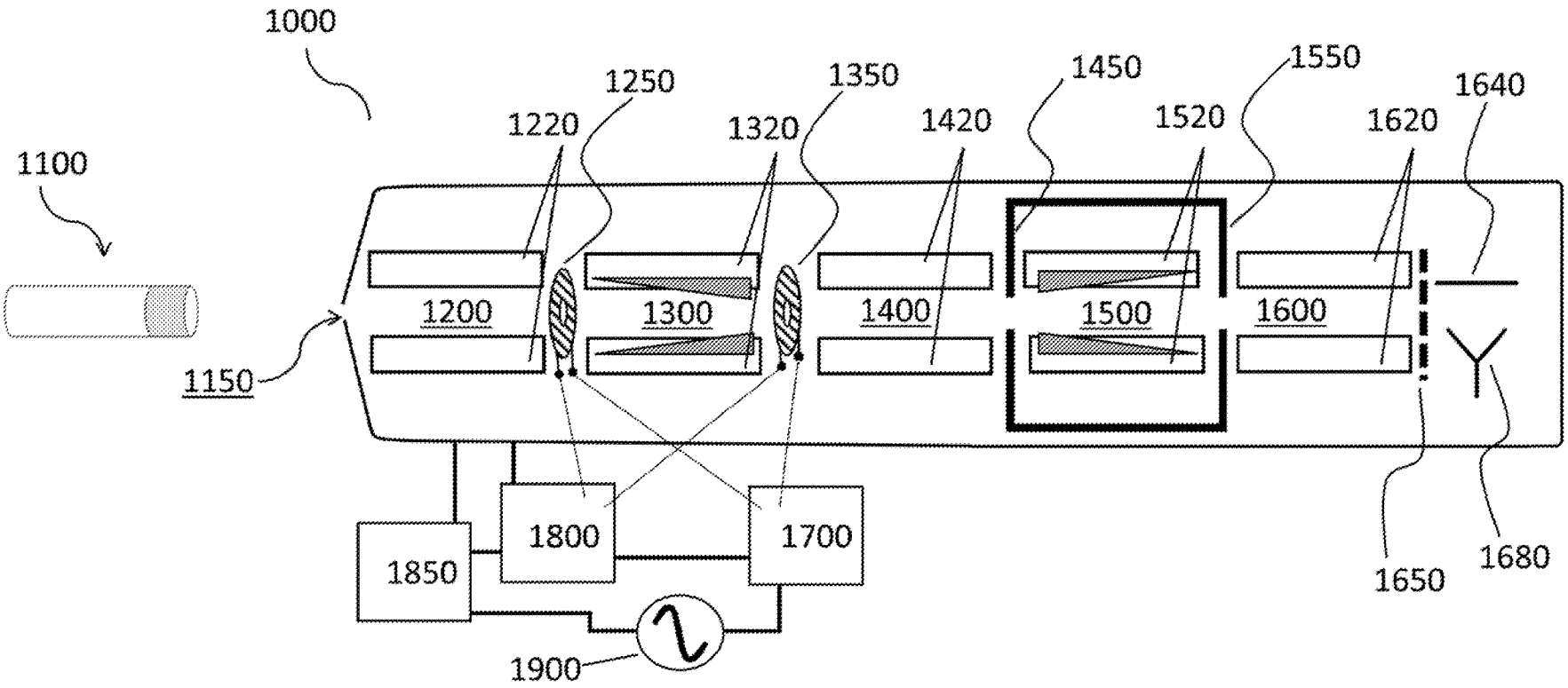
FIG. 8, in a schematic diagram, illustrates a mass spectrometry system in accordance with various embodiments of the present disclosure.

An ion lens assembly according to the present teachings can be incorporated in a variety of different mass spectrometry systems. By way of example, FIG. 8 schematically depicts a mass spectrometry system 1000 according to an embodiment of the present teachings, which includes an ion source 1100 for generating ions. An interface 1150 is disposed between the ion source 1100 and the downstream components of the mass spectrometer, where the interface 1150 includes an opening through which ions can enter the downstream components.

The ion source 1100 can be any known or hereafter developed ion source for generating ions and modified in accordance with the present teachings. Non-limiting examples of ion sources suitable for use with the present teachings include atmospheric pressure chemical ionization (APCI) sources, electrospray ionization (ESI) sources, continuous ion source, a pulsed ion source, an inductively coupled plasma (ICP) ion source, a matrix-assisted laser desorption/ionization (MALDI) ion source, a glow discharge ion source, an electron impact ion source, a chemical ionization source, or a photo-ionization ion source, among others. In some embodiments, an ion source region is or can be maintained at a pressure near atmospheric pressure.

The mass spectrometry system 1000 can include one or more ion guides that channel and/or focus the ions downstream in the mass spectrometry system. In some embodiments, for example, the ion guides can be used to capture and focus ions using a combination of gas dynamics and radio frequency fields. In some embodiments, the one or more ion guides can include elongated rod sets, for example, quadrupole rod sets including four rods arranged in a quadrupole configuration, though the elongated rod sets can be any other suitable multipole configurations, for example, hexapoles, octupoles, etc. In some embodiments, a set of stubby rods (not visible in this figure) can also be provided between neighboring pairs of quadrupole rod sets to facilitate the transfer of ions between the quadrupole rod sets. The stubby rods can serve as a Brubaker lens and can help minimize interactions with any fringing fields that may have formed in the vicinity of an adjacent lens, for example, if the lens is maintained at an offset potential.

Mass spectrometry system 1000 includes an ion guide 1220 that is housed in a first ion guide chamber 1200. Another ion guide 1320, for example, a quadrupole rod set, is positioned downstream of the ion guide 1220 within an ion chamber 130. A first ion lens assembly 1250 according to the present teachings is disposed between the ion guide 1220 and the ions filter 1320.

Mass spectrometry system 1000 further includes one or more mass analyzers 1420, a collision cell 1520, and another mass analyzer 1620 that can be housed downstream in the mass spectrometry system from the first and second ion lens assemblies. It will be appreciated that the exemplary downstream elements (1420, 1520, and 1620) are shown with mass spectrometry system 1000, more or fewer downstream elements could be included with mass spectrometry systems in accordance with the present disclosure. For convenience, one or more mass analyzers 1420, 1620 and collision cell 1520 can include elongated rod sets, for example, four rods arranged in a quadrupole configuration, though the elongated rod sets can be any other suitable multipole configurations, for example, hexapoles, octupoles, etc. It will also be appreciated that the one or more mass analyzers can be any of triple quadrupoles, linear ion traps, quadrupole time of flights, Orbitrap or other Fourier transform mass spectrometry systems, all by way of non-limiting example.

The mass analyzers, 1420, 1520, and 1620 can be disposed in adjacent chambers 1400, 1500, and 1600 respectively. The mass spectrometry system 1000 can be configured to operate as a single vacuum chamber. The single vacuum chamber can be maintained at a pressure less than about $5\times10^{-3}$ Torr. By way of non-limiting example, the single vacuum chamber can be maintained at a pressure of about $5\times10^{-5}$ Torr to about $1\times10^{-8}$ Torr, though other pressures can be used for this or for other purposes. As one of skill in the art will understand, pressures will vary depending on sample load.

Mass spectrometry system 1000 can further include an exit lens 1650, a deflector 1640, and a detector 1680. The exit lens 1650 can be positioned between mass analyzer 1620 and the detector 1680 to control ion flow into the detector 1680.

As shown in FIG. 8, the exemplary mass spectrometry system 1000 can additionally include one or more power supplies, for example, RF power supply 1900, the above disclosed DC power supply 1800 that can be controlled by a controller 1850. It will be appreciated that the one or more power supplies 1800 and 1900 that can be controlled by controller 1850 so as to apply electric potentials with RF, AC, and/or DC components, for example, to quadrupole rods, and/or various lenses to configure the elements of the mass spectrometry system 100 for various different modes of operation depending on the particular application. It will be further appreciated that the controller 1850 can also be linked to the various elements in order to provide joint control over the executed timing sequences. Accordingly, the controller 1850 can be configured to provide control signals to the power source(s) 1800 and 1900 supplying voltage (power) to the various components in a coordinated fashion in order to control the mass spectrometry system 1000 as otherwise discussed herein.

During operation of the mass spectrometry system 1000, pulsed ions, neutrals, and other gas can be generated by the ion source 1100. Ions pass through the interface 1150, enter the first ion guide chamber 1200, traverse one or more additional vacuum chambers and/or quadrupoles of the second ion guide chamber 1300. Through these stages, the ions form a coherent ion beam, which can provide additional focusing of and finer control over the ion beam using a combination of gas dynamics and radio frequency fields. In some embodiments, the first ion guide 1220 transfers ions received thereby to subsequent ion optics such as the second ion guide 1320 through the ion lens 1250 disposed therebetween. The second ion guide 1320 transports and delivers ions through the ion lens 1350 to the mass analyzers, 1420.

After being transmitted from the second ion guide chamber 1300, the m/z separated ions can enter the adjacent quadrupole rod set 1420. As will be appreciated by a person of skill in the art, the quadrupole rod set 1420 can be operated as a conventional transmission RF/DC quadrupole mass filter that can be operated to select an ion of interest and/or a range of ions of interest. By way of example, the quadrupole rod set 1420 can be provided with RF/DC voltages suitable for operation in a mass-resolving mode. In some embodiments, taking the physical and electrical properties of the mass analyzer 1420 into account, parameters for an applied RF and DC voltage can be chosen so that the mass analyzer 1420 establishes a transmission window specific to the selected m/z ions, such that these ions can traverse the mass analyzer 1420 largely unperturbed. Ions having m/z ratios falling outside the window, however, do not attain stable trajectories within the quadrupole and can be prevented from traversing the mass analyzer 1420.

Ions passing through the mass analyzer 1420 can pass through an aperture lens 1450 and into the adjacent collision cell 1520, which as shown can be disposed in a pressurized compartment and can be configured to operate at a pressure approximately in the range of from about 1 mTorr to about 10 mTorr, though other pressures can be used for this or for other purposes. A suitable collision gas, for example, nitrogen, argon, helium, etc. can be provided by way of a gas inlet (not visible in this figure) to thermalize and/or fragment ions in the ion beam. In some embodiments, application of suitable RF/DC voltages to the quadrupole rod set 1520 and entrance and exit lenses 1450 and 1550 can provide optional mass filtering.

Ions that are transmitted by 1520 can pass into the adjacent quadrupole rod set 162, which is bounded upstream by the aperture lens 1550 and downstream by the exit lens 1660. As will be appreciated by a person skilled in the art, the quadrupole rod set 1620 can be operated at a decreased operating pressure relative to that of 1520. As will be appreciated by a person skilled in the art, the mass analyzer 1620 can be operated in a number of manners, for example as a scanning RF/DC quadrupole or as a linear ion trap. Following processing or transmission through the 1620, the ions can be transmitted into the detector 1640 through the exit lens 1660. The detector 1640 can then be operated in a manner known to those skilled in the art in view of the systems, devices, and methods described herein. As will be appreciated by a person skill in the art, any known detector, modified in accord with the teachings herein, can be used to detect the ions.

Figure 9:
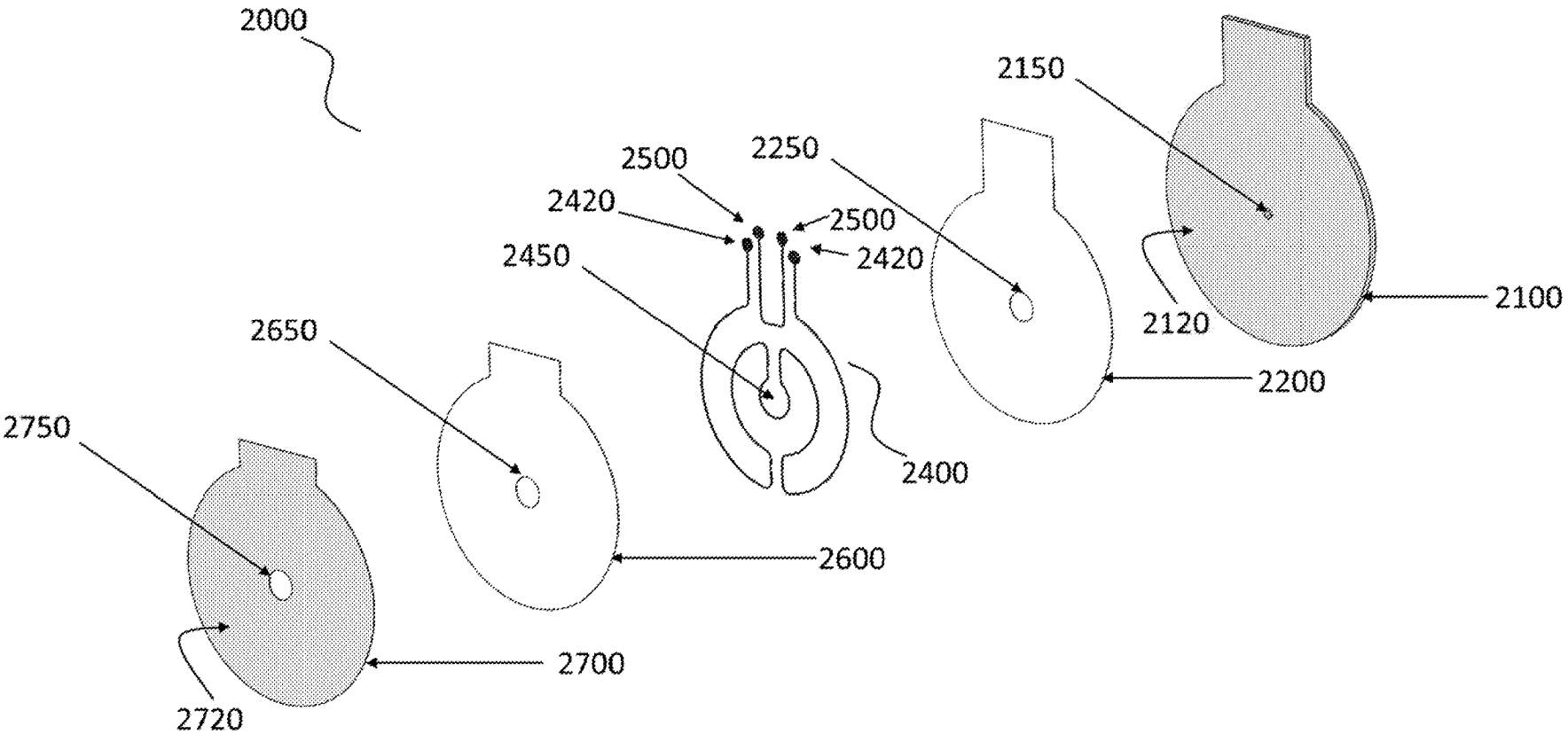
FIG. 9, in a schematic diagram, illustrates an exploded view of an ion lens assembly shown with an electrically conductive rear layer in accordance with one aspect of various embodiments of the present disclosure.

FIG. 9, in a schematic diagram, illustrates an exploded view of an ion lens assembly 2000 in accordance with one aspect of various embodiments of the present disclosure. The ion lens assembly 2000, which is shown in an exploded view includes a front cap layer 2700, a rear layer 2100, and a heating element 2400 that is disposed between the front cap layer 2700 and the rear layer 2100 to provide direct heating of the ion lens assembly 2000. The front cap layer 2700, the rear layer 2100, and the heating element 2400 include central openings 2750, 2150, and 2450, respectively, that are substantially aligned to allow the passage of an ion beam through the ion lens assembly 2000.

In this embodiment, the heating element 2400 is sandwiched between two insulating layers 2200 and 2600, which electrically insulate the heating element 2400 from the front cap layer 2700 and the rear layer 2100. Other embodiments of an ion lens assembly according to the present teachings may not include such insulating layers, as discussed in more detail below.

The front cap layer 2700 includes a forward surface 2720 that faces an incoming ion beam generated by an upstream ion source when the ion lens assembly is incorporated into a mass spectrometry system. Further, the rear layer 2100 includes a forward surface 2120 that is in contact with the insulating layer 2200 and a backward surface (not visible in this figure), which opposes the forward surface 2120 and faces downstream components of a mass spectrometry system in which the ion lens assembly 2000 is incorporated. The trajectory of the ions as they enter the ion lens assembly 2000, traverse through the ion lens assembly and exit the ion lens assembly 2000 is susceptible to contamination deposited on various surfaces of the ion lens assembly, and particularly the forward surface 2720 of the front cap layer 2700 and the backward surface (not visible in this figure) of the rear layer 2100, and especially in surface regions in proximity of the openings 2750 and 2150. The heating of the ion lens assembly 2000, and particularly these surfaces via the heating element 2400 can at least partially remove and/or reduce such contamination and hence improve the performance of the mass spectrometry system.

In this embodiment, the front cap layer 2700 is formed of materials, such as those discussed above. In this embodiment, the electrically conductive front cap layer can be formed by depositing, for example, via electrodeposition, a metallic layer on a surface of the insulating layer 2600 that is opposed to a surface of the insulating layer that is in contact with the heating element. Further, in this embodiment, the rear layer 2100 is formed of a metal, such as, aluminum, copper, stainless steel, etc. The insulating layers 2200 and 2600 can in turn be formed of a dielectric material, such as a ceramic.

In this embodiment, the heating element includes a flexible heater. The heating element includes at least two pins 2420 that can be employed to connect the flexible heater to a voltage source, for example, a dc voltage source, such as the dc voltage source 1800 depicted in FIG. 8). In some embodiments, the application of the dc voltage to the heating element generates heat that raises the temperature of the ion lens assembly to an elevated temperature, for example, a temperature in a range of about 100° C. to about 130° C. The raising of the temperature of the ion lens assembly, and in particular, the forward surface of the front cap layer, which faces the incoming ions, and the backward surface of the rear layer, which faces the downstream components of a mass spectrometry system in which the ion lens assembly is incorporated, can cause the desorption of contamination deposited on these surface and/or inhibit the deposition of contaminating ions and/or neutral species on these surfaces, thereby enhancing the performance of the mass spectrometry system.

With continued reference to FIG. 9, in this embodiment, the heating element 2400 includes a temperature sensor in the form of an electrical resistive trace 2500 that includes two terminals that can be attached to a measurement device (not visible in this figure), which can convert the measured resistance of the resistive trace to a temperature.

As discussed above, the front cap layer and the rear layer can be formed of a variety of different materials. For example, in the embodiment depicted in FIG. 9, the rear layer is formed from an electrically conductive metallic layer. In other embodiments, the rear layer can be formed of an electrically non-conductive material, such as, a dielectric, a ceramic, glass, etc. Specifically, FIG. 10, a schematic diagram, illustrates an exploded view of an ion lens assembly 3000 in accordance with one aspect of various embodiments of the present disclosure. The ion lens assembly 3000, which is shown in an exploded view, includes a front cap layer 3500, a rear layer 3100, and a heating element 3200 that is disposed between the front cap layer 3500 and the rear layer 3100 to provide direct heating of the ion lens assembly 3000. The front cap layer 3500, the rear layer 3100, and the heating element 3200 include central openings 3550, 3150, and 3450, respectively, that are substantially aligned to allow the passage of an ion beam through the ion lens assembly 3000.

The front cap layer 3500 includes a forward surface 3520 that faces an incoming ion beam generated by an upstream ion source when the ion lens assembly is incorporated into a mass spectrometry system. Further, the rear layer 3100 includes a forward surface 3120 that is in contact with the heating element 3200 and a backward surface (not visible in this figure) that opposes the forward surface 3120 that faces downstream components of a mass spectrometry system in which the ion lens assembly 3000 is incorporated. The trajectory of the ions as they enter the ion lens assembly, traverse the ion lens assembly and exit the ion lens assembly 3000 is susceptible to contamination deposited on various surfaces of the ion lens assembly, such as the forward surface 3520 of the front cap layer 3500 and the backward surface (not visible in this figure) of the rear layer 3100, and particularly in surface regions in proximity of the openings 3550 and 3150. The heating of the ion lens assembly 3000, and particularly these surfaces via the heating element 3200, can at least partially remove and/or reduce such contamination and hence improve the performance of the mass spectrometry system.

In this embodiment, the front cap layer 3500 is formed from a metal coating deposited on a surface of the electrically insulating layer 2600, though in other embodiments, the front cap layer 3500 can be formed of other materials, such as those discussed above. Further, in this embodiment, the rear layer 3100 is formed of a non-electrically conductive material, such as, a dielectric, a ceramic, glass, etc.

In this embodiment, the heating element includes a flexible heater. The heating element includes at least two pins 3220 that can be employed to connect the flexible heater to a voltage source, for example, a dc voltage source (not visible in this figure). In some embodiments, the application of the dc voltage to the heating element generates heat that raises the temperature of the ion lens assembly to an elevated temperature, for example, a temperature in a range of about 100° C. to about 130° C. The raising of the temperature of the ion lens assembly, and in particular, the forward surface of the front cap layer, which faces the incoming ions, and the backward surface of the rear layer, which faces the downstream components of a mass spectrometry system in which the ion lens assembly is incorporated, can cause the desorption of contamination deposited on these surfaces and/or inhibit the deposition of contaminating ions and/or neutral species on these surfaces, thereby enhancing the performance of the mass spectrometry system.

Figure 10:
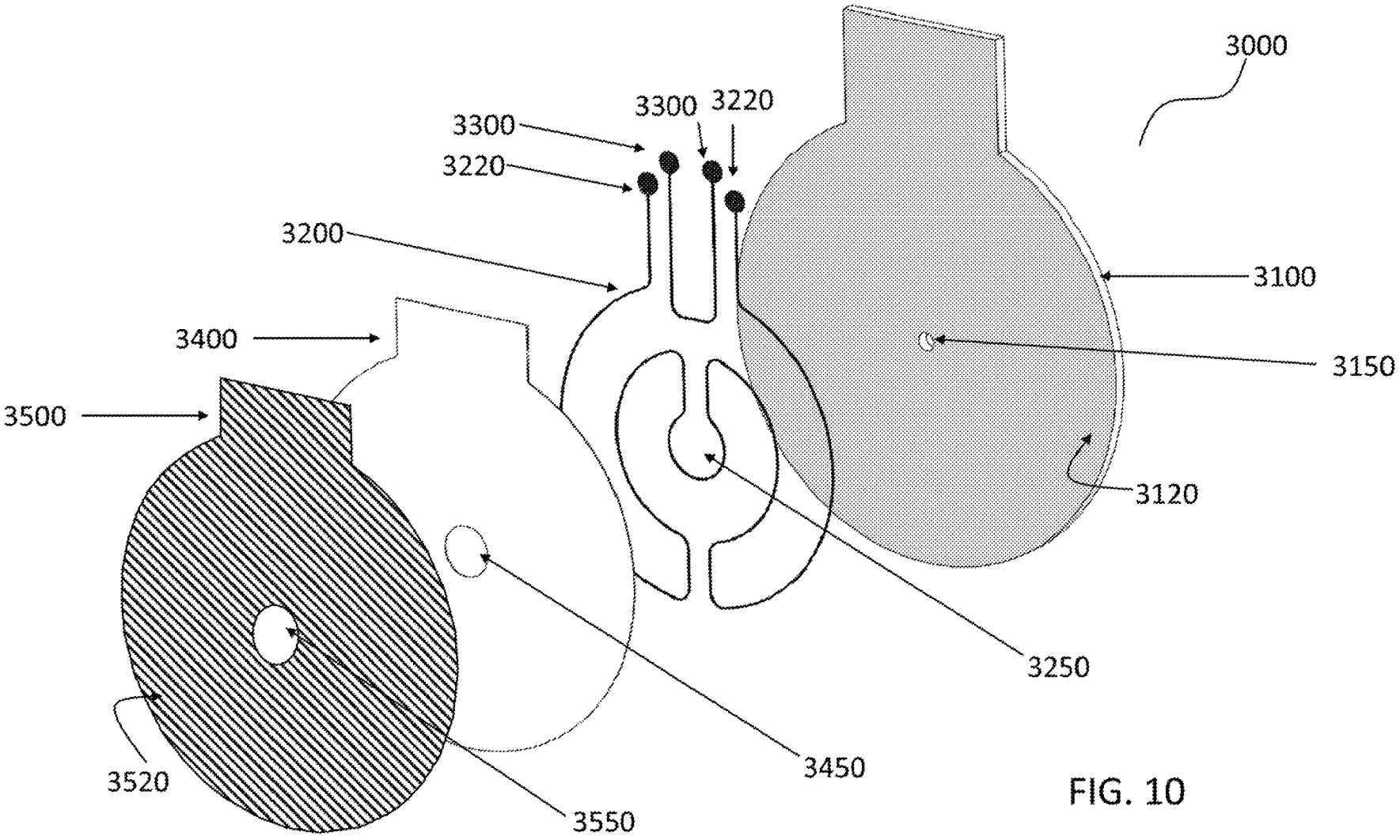
FIG. 10, in a schematic diagram, illustrates an exploded view of another ion lens assembly shown with an electrically non-conductive rear layer in accordance with one aspect of various embodiments of the present disclosure.

With continued reference to FIG. 10, similar to the previous embodiment, in this embodiment, the heating element 3200 includes a temperature sensor in the form of an electrical resistive trace 3300, which includes two terminals that can be attached to a measurement device (not visible in this figure), which can convert the measured resistance of the resistive trace to a temperature.

Figure 11:
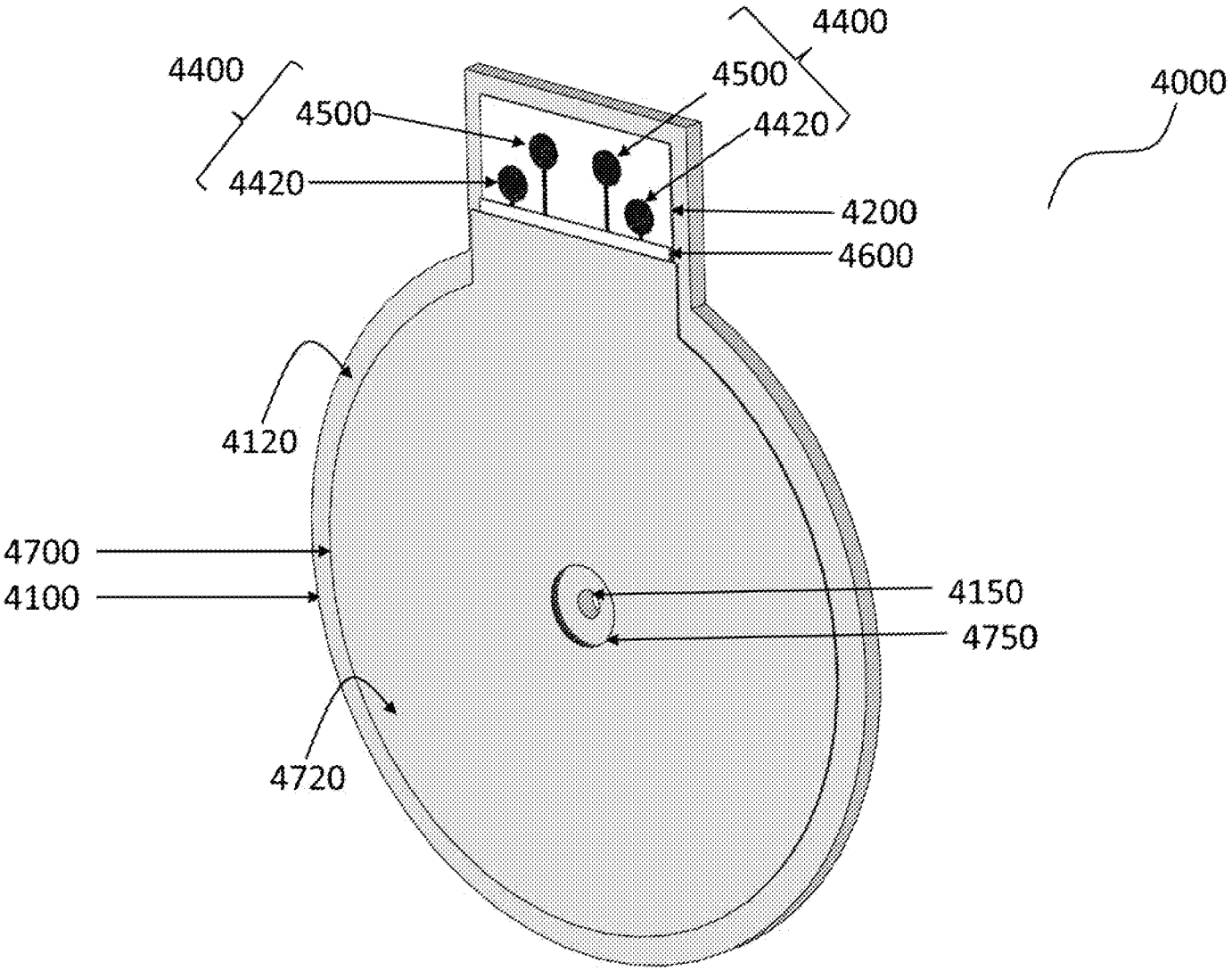
FIG. 11, in a schematic diagram, illustrates an ion lens assembly in accordance with one aspect of various embodiments of the present disclosure.

FIG. 11, in a schematic diagram, illustrates an ion lens assembly 4000 in accordance with one aspect of various embodiments of the present disclosure. Ion lens assembly 4000 is shown as an assembled unit (rather than the above exploded views). The ion lens assembly 4000 includes a front cap layer 4700, a rear layer 4100, and a heating element 2400 that is disposed between the front cap layer 4700 and the rear layer 4100 to provide direct heating of the ion lens assembly 4000. The front cap layer 4700, the rear layer 4100, and the heating element 4400 include central openings 4750, 4150, which allow the passage of ions through the assembly (the heating element is disposed between the layers so as not to impede the passage of ions through the ion lens assembly).

In this embodiment, the heating element 4400 is sandwiched between two insulating layers 4200 and 4600, which electrically insulate the heating element 4400 from the front cap layer 4700 and the rear layer 4100. Other embodiments of an ion lens assembly according to the present teachings may not include such insulating layers, as discussed throughout the present disclosure in more detail.

The front cap layer 4700 includes a forward surface 4720 that faces an incoming ion beam generated by an upstream ion source when the ion lens assembly is incorporated into a mass spectrometry system, and a backward surface (not visible in this figure) that opposes the forward surface 4720 that is in contact with the insulating layer 4600. Further, the rear layer 4100 includes a forward surface 4120 that is in contact with the insulating layer 4200 and a backward surface (not visible in this figure) that opposes the forward surface 4120 that faces downstream components of a mass spectrometry system in which the ion lens assembly 4000 is incorporated. The trajectory of the ions through the ion lens assembly 4000 and as they enter the ion lens assembly 4000, traverse through the ion lens assembly and exit the ion lens assembly is susceptible to contamination deposited, for example, on the forward surface 4720 of the front cap layer 4700 and the backward surface (not visible in this figure) of the rear layer 4100, and particularly in surface regions in proximity of the openings 4750 and 4150. The heating of the ion lens assembly 4000, and particularly these surfaces via the heating element 4400 can at least partially remove and/or reduce such contamination and hence improve the performance of the mass spectrometry system.

In this embodiment, the front cap layer 4700 is formed as a stand-alone unit (rather than a metal coating deposited on an insulating layer) from a metal, such as those discussed above. In other embodiments, the front cap layer 4700 can be formed as a metal coating, for example, as discussed in connection with the previous embodiments. Further, in this embodiment, the rear layer 4100 is formed of a metal, such as, aluminum, copper, stainless steel, etc. In this embodiment, the heating element includes a flexible heater. The heating element includes at least two pins 4420 that can be employed to connect the flexible heater to a voltage source, for example, a dc voltage source (not visible in this figure). In some embodiments, the application of the dc voltage to the heating element generates heat that raises the temperature of the ion lens assembly to an elevated temperature, for example, a temperature in a range of about 100° C. to about 130° C. The raising of the temperature of the ion lens assembly, and in particular, the forward surface of the front cap layer, which faces the incoming ions, and the backward surface of the rear layer, which faces the downstream components of a mass spectrometry system in which the ion lens assembly is incorporated, can cause the desorption of contamination deposited on these surface and/or inhibit the deposition of contaminating ions and/or neutral species on these surfaces, thereby enhancing the performance of the mass spectrometry system.

With continued reference to FIG. 11, in this embodiment, the heating element 4400 includes a temperature sensor in the form of an electrical resistive trace 4500 that includes two terminals that can be attached to a measurement device (not visible in this figure), which can convert the measured resistance of the resistive trace to a temperature. As explained above, in some embodiments, the rear layer 4100 can be formed of an electrically insulating material. By way of example, a dielectric material and/or ceramic. In such an embodiment, the final assembly and its operation would be comparable, however, the insulating layer 4200 shown above could be a redundancy.

Figure 12:
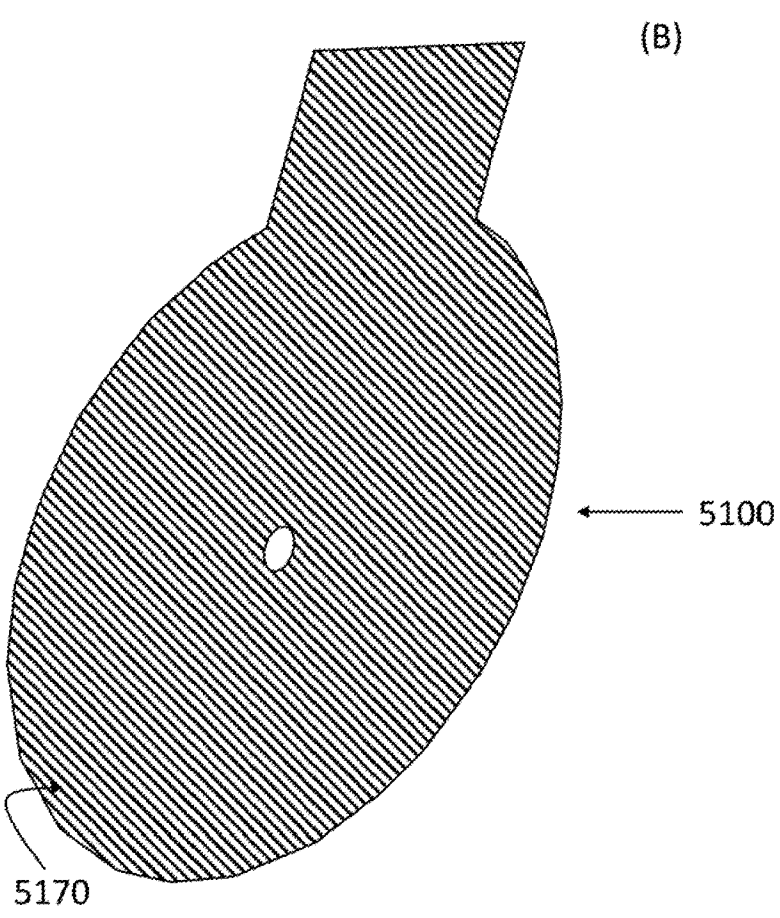
FIG. 12, in a schematic diagram, illustrates a sub-assembly of an ion lens assembly showing a rear layer of a lens in accordance with one aspect of various embodiments of the present disclosure.
Figure 12:
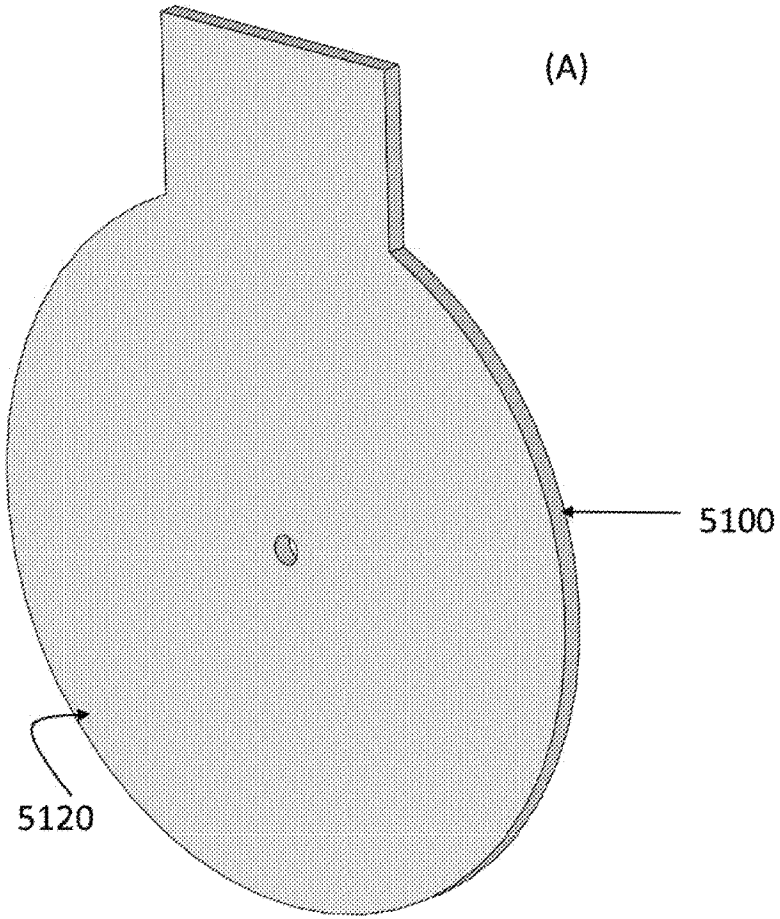

FIG. 12 in a schematic diagram, shows a sub-assembly of an ion lens assembly, i.e., a rear layer 5100 in accordance with one aspect of various embodiments of the present disclosure is shown. With reference to FIG. 12 at panel (A), the rear layer 5100 is shown to include a forward surface 5120. In some embodiments in which the rear layer 5100 is formed of a non-electrically conducting material, such as a ceramic, the forward surface 5120 can be in physical contact with a heating element (not visible in this figure). In some embodiments in which the rear layer 5100, is formed of an electrically conducting material, such as a metal, the forward surface 5120 can be separated from the heating element via an electrically insulating layer (not visible in this figure). With reference to FIG. 12 at panel (B), the rear layer 5100 is shown to include a rear surface 5170 that opposes the forward surface 5120 that faces downstream components of a mass spectrometry system in which the ion lens assembly is incorporated.

Figure 13:
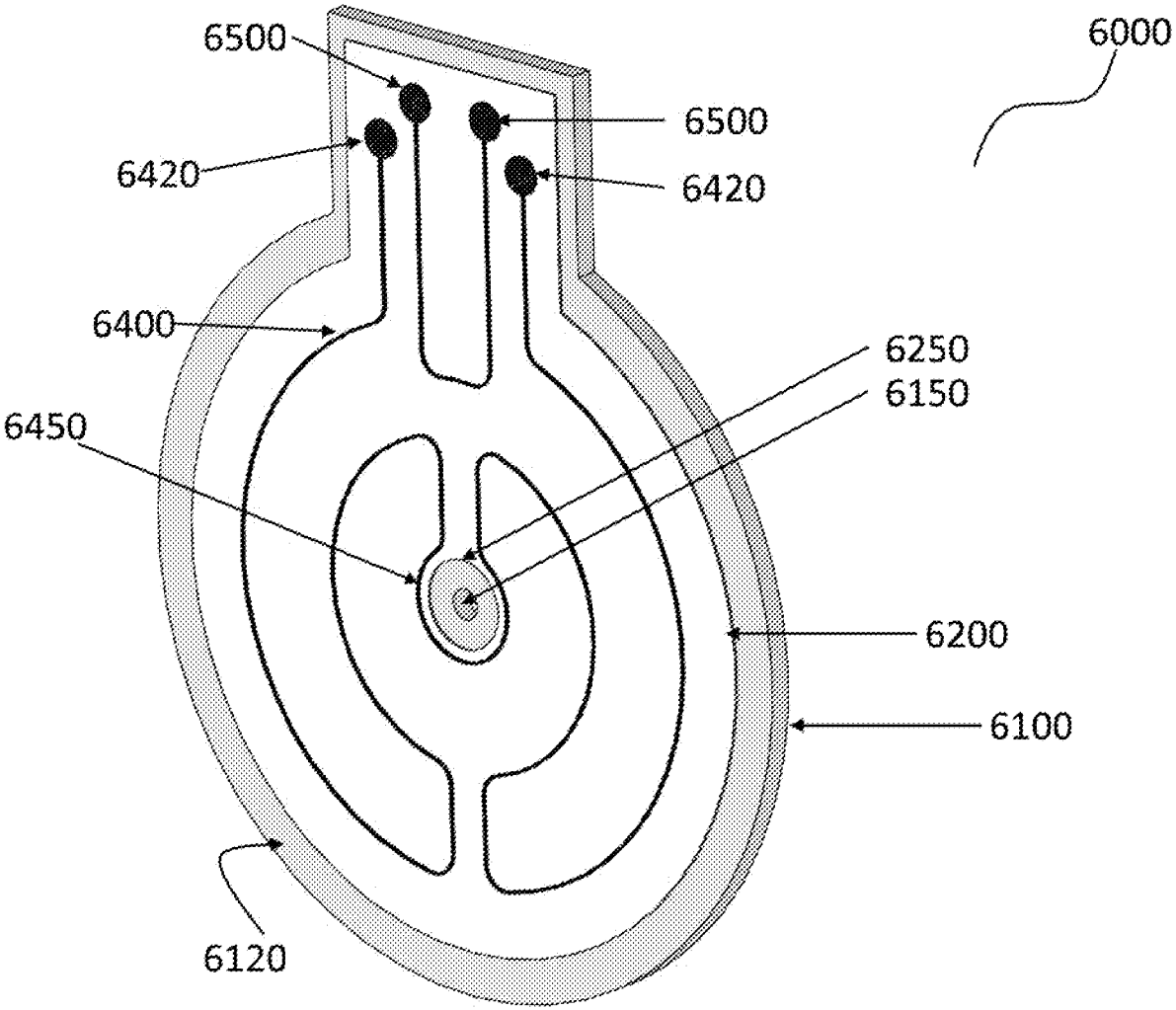
FIG. 13, in a schematic diagram, illustrates a sub-assembly of an ion lens assembly showing a rear layer, an insulating layer in contact with a forward surface of the rear layer and a heating element in the form of a resistive trace disposed on a forward surface of the insulating layer.

The heating element incorporated into an ion lens assembly according to the present teachings can be configured in a variety of different ways. For example, FIG. 13, in a schematic diagram, shows a heating element 6400, which is in the form of a resistive trace deposited on a surface of an insulating layer 6200, which separates the heating element from a rear layer 6100, which can be formed of a metal. The heating element 6400 includes two terminals 6420 that can be employed to couple the heating element to a voltage source. Further, in this embodiment, a resistive trace 6500 on the surface of the insulating layer to function as a temperature sensor, for example, in a manner discussed above in connection with the previous embodiment.

Figure 14:
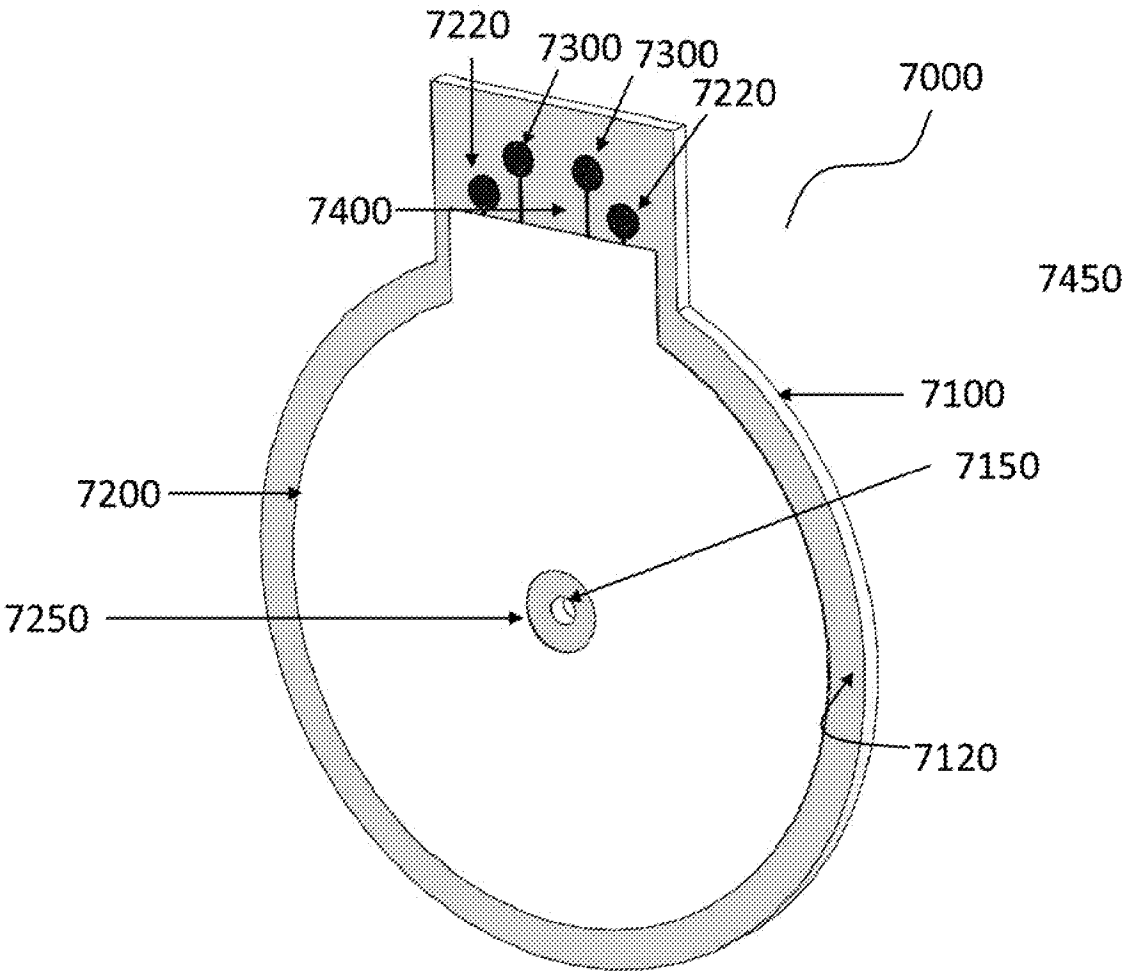
FIG. 14, in a schematic diagram, illustrates a sub-assembly of an ion lens assembly showing a forward surface of a rear layer in contact with a heating element and a temperature sensor are disposed on a backward surface of a dielectric layer.

As discussed above, in some embodiments, the rear layer of an ion lens assembly according to the present teachings can be formed of an electrically non-conducting material, such as ceramic or glass. FIG. 14, in a schematic diagram, shows a sub-assembly 7000 of such an embodiment, which includes a rear layer 7100 formed of an electrically non-conducting material. In this embodiment, a heating element 7400 can be deposited, for example, as a resistive trace, on a forward surface 7120 of the rear layer 7100 for direct heating of the ion lens assembly. Further, an electrical resistive trace 7300 is also deposited on the forward surface 7120 of the rear layer 7100 to function as a temperature sensor, for example, a in a manner discussed above in connection with the previous embodiments. An insulating layer 7200 is disposed over the heating element to separate the heating element from an electrically conducting cap layer (not visible in this figure), which can be, for example, formed as a metal coating on the insulating layer. Similar to the previous embodiments, the insulating layer 7200 and the rear layer 7100 include central openings 7250, 7150, respectively, which allow the passage of an ion beam therethrough. The heating element 7400 includes at least two pins 7220 that can be employed to connect the heating element to a voltage source, for example, a dc voltage source (not visible in this figure).

In some embodiments, as explained, the heating element can be heated with a fluid that is plumbed therethrough. In some embodiments, the heating element can include one or more channels, conduits, fluidic pathways, tubes, tunnels, etc. that extend in and/or between layers of the lens assembly. By way of example, such channels, conduits, fluidic pathways, passages, tubes, tunnels, etc. can be configured and/or plumbed to transport or flow a fluid therethrough. In some embodiments, the fluid can include, for example, alcohol, ammonia, glycerine, glycol, and/or water. In some embodiments, the fluid can be preheated. In some embodiments, the fluid can include two or more reagents that upon contact exothermically react to generate heat.

Figure 15:
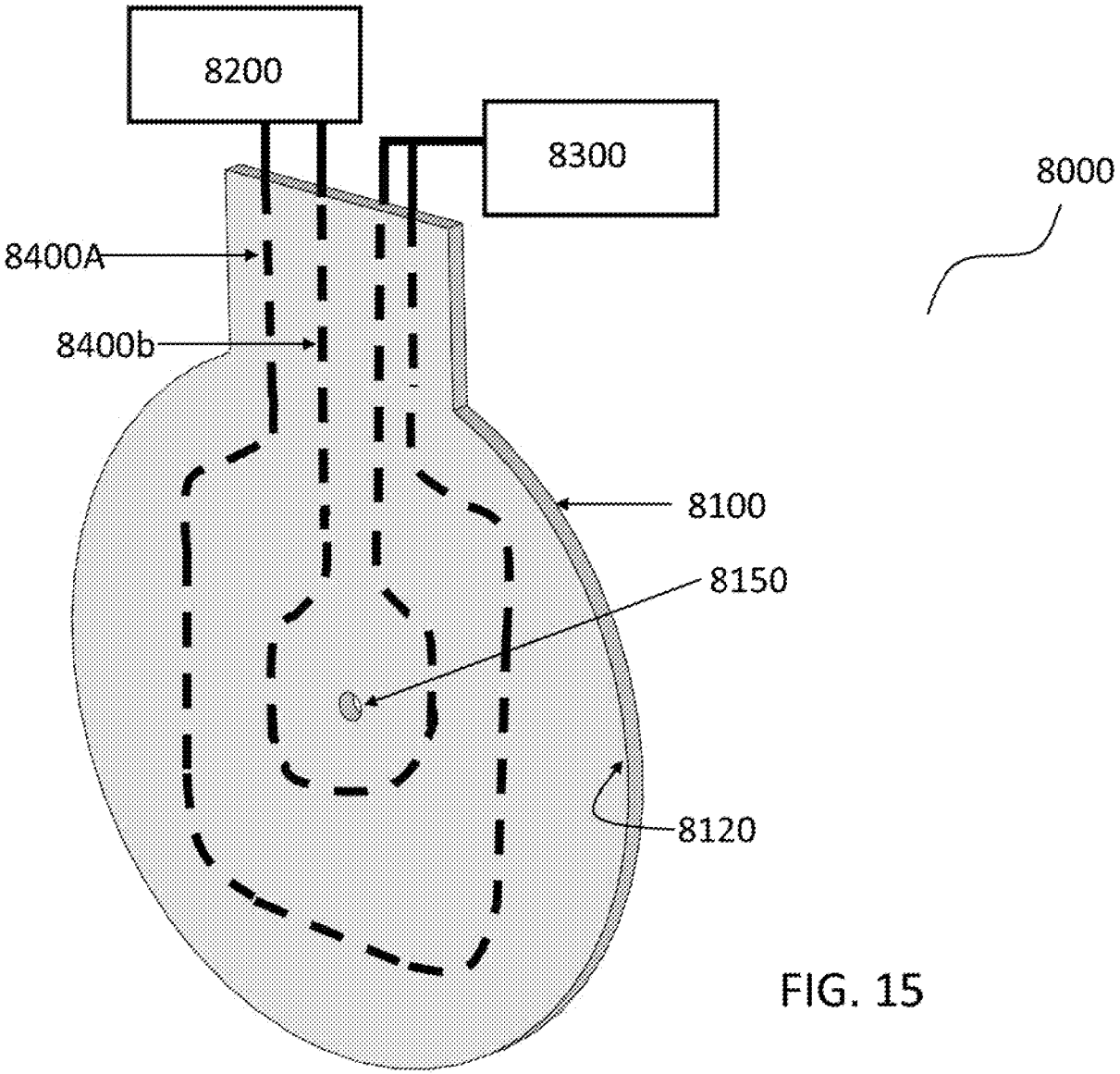
FIG. 15, in a schematic diagram, illustrates a sub-assembly of an ion lens assembly showing the rear layer of which a heating element including a fluidic channel disposed therein.

As shown schematically, FIG. 15, shows a sub-assembly 8000 of such an embodiment, which includes a rear layer 8100. The rear layer 8100 can be formed of either an electrically conducting or non-conducting material. In this embodiment, a heating element can include a series of channels 8400A and 8400B (shown in dashed line) fluidly coupled to a heated fluid source 8200 and a fluid return 8300. The channels 8400A and 8400B (shown in dashed line) are tubes or pathways formed within the rear layer 8100 and underneath the surfaces of the rear layer, for example, beneath the forward surface of the rear layer 8120. As with prior embodiments, the rear layer 8100 includes a central opening 8150, which allows the passage of an ion beam therethrough.

Figure 16:
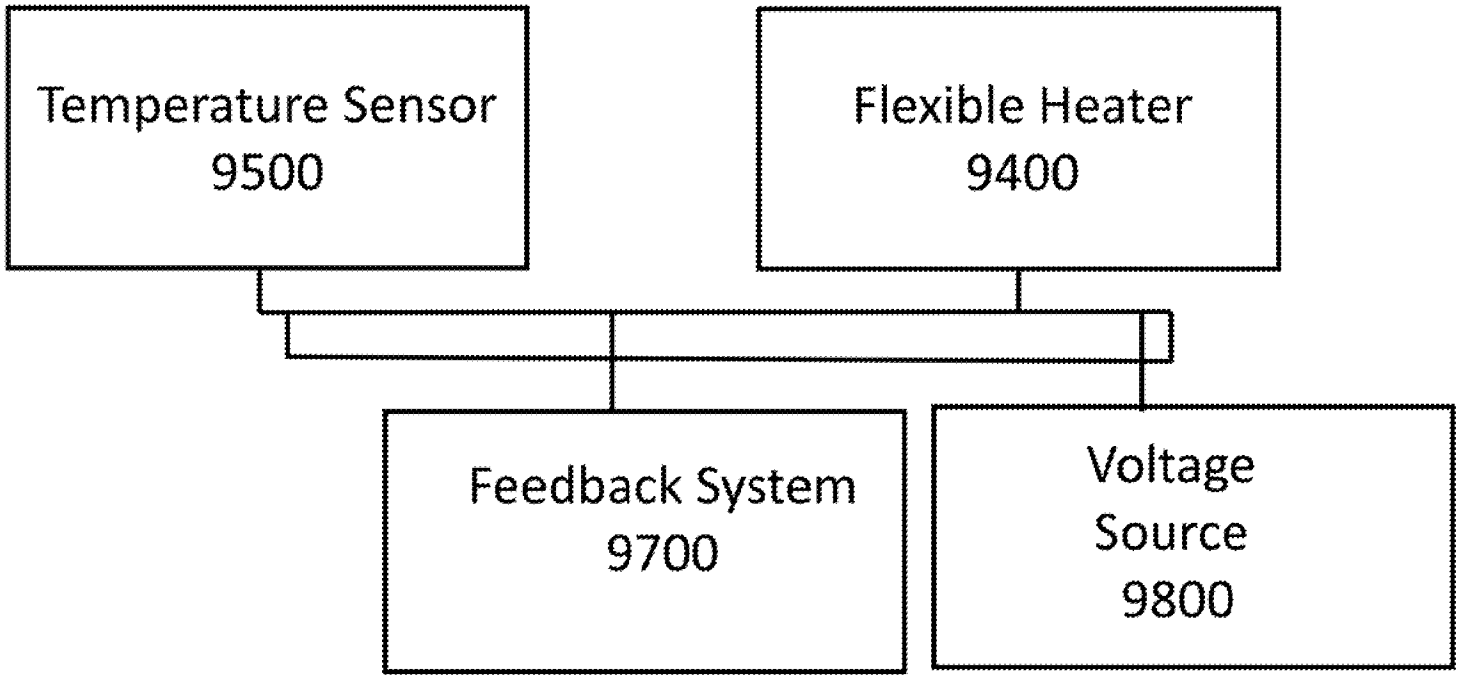
FIG. 16, schematically illustrates an exemplary implementation of a system for maintaining the temperature of an ion lens assembly according to the present teachings within a desired range using a temperature sensor and a feedback circuitry.

As noted above, in some embodiments, an ion lens assembly according to the present teachings including a heating element for direct heating of the ion lens assembly as well as a temperature sensor for measuring temperature of the ion lens assembly. As shown schematically in FIG. 16, in this embodiment, an ion lens assembly according to the present teachings can include a heating element, for example, a flexible heater 9400, which receives a dc voltage from a voltage source 9800 and converts the electrical power into heat for direct heating of the ion lens assembly. The ion lens assembly further includes a temperature sensor 9500 that is configured to be in communication with a feedback system 9700, which receives signals indicative of the temperature of the ion lens assembly from the temperature sensor 9500. The feedback system 9700 can in turn communicate with the voltage source 9800 to adjust the voltage applied to the temperature sensor 9500 so as to maintain the temperature of the ion lens assembly within a predefined range.

For example, if the temperature sensor 9500 indicates a temperature that is lower than a predefined lower threshold, the feedback system 9700 can cause the voltage source 9800 to increase the voltage level applied to flexible heater 9400, and if the temperature sensor 9500 indicates a temperature that is greater than an upper threshold, the feedback system 9700 can cause the voltage source 9800 to lower the voltage applied to the flexible heater 9400.

Exemplification

The following examples illustrate some embodiments and aspects of the present disclosure. It will be apparent to those skilled in the relevant art that various modifications, additions, substitutions, and the like can be performed without altering the spirit or scope of the disclosure, and such modifications and variations are encompassed within the scope of the disclosure as defined in the claims, which follow. The present disclosure will be more fully understood by reference to these examples. The following examples do not in any way limit the present disclosure or the claimed disclosures and they should not be construed as limiting the scope.

EXAMPLES

Materials and Methods

Mass Spectrometry System

A 6500+ QTRAP instrument with an Ion Drive source was used for all experiments. This spectrometer includes an ion guide (Q0), followed by a heated ion lens assembly according to the present teachings which was used between Q0 and Q1. The lens assembly included a front layer formed of a conductive coating of silver palladium alloy and an insulating layer formed of Dupont multilayer dielectric (P/N 5704). A resistive heating element composed of Heraeus C4082 thick film ink was incorporated in the lens assembly between the front layer and the rear layer.

Chemicals

A 10 pg/μL reserpine standard prepared in standard cryoproof buffer solution was used to baseline the instrument and trace the intensity change during contamination experiments.

The lipid solution used in these experiments was prepared by dilution from a stock solution of extra virgin Olive Oil. The dilution solvent comprised 2:1 methanol/chloroform with 5 mM ammonium acetate.

Highly accelerated contamination tests were conducted using a 1000-fold dilution of the olive oil sample to yield ~3 mM lipid content.

Example 1

The present example discloses operation and performance parameters for an ion lens assembly in accordance with one aspect of various embodiments of the present disclosure.

The ion lens assembly in accordance with the present disclosure was seated in such a manner as to provide a mass peak having a typical peak shape. A series of tests were then performed to determine if the heated ion lens could meet standard performance specifications. Specifically, as above noted, tests were performed to assess the performance of the mass spectrometry system when a standard ion lens was switched with a heated ion lens assembly according to the present teachings.

The ion lens assembly was maintained at 100° C. during ramping. The shape of the ramping data obtained was comparable to what is typically observed on a standard instrument, thereby confirming that the ion lens assembly provided acceptable ramping performance. A 10 pg/μL sample of reserpine was leaked into the mass spectrometry system during operation. The ion lens assembly was maintained at 100° C. during the process. The peak shape having both a sample load applied and heating applied did not impact lens performance. The heated ions lens assembly performed comparable to what is typically observed when operating sampling a 10 pg/μL sample of reserpine.

Example 2

The present example discloses accelerated robustness data for an ion lens assembly in accordance with one aspect of various embodiments of the present disclosure.

In some embodiments, upon installation of ion lens assemblies of the present disclosure, instrumental performance was essentially unchanged when compared with standard ion lenses. Occasional Q1 peak shape differences were noted between standard ion lenses and ion lens assemblies of the present disclosure.

In addition to above typical functional parameters, ion lens assemblies of the present disclosure were assessed for robustness.

A long term robustness test, using diluted olive oil, to provide a quantitative comparison of instrument robustness was previously described for use across different platforms of mass spectrometry systems. (See Schneider B B et al., "Cross Platform Comparison of Robustness using a Lipid Contamination Protocol, Oct. 25, 2015). A similar long term robustness test has been used here to assess robustness of ion lenses and specifically, ion lens assemblies of the present disclosure.

Figure 17:
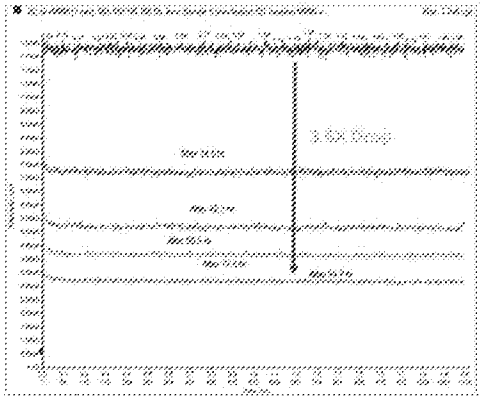
FIG. 17 depicts comparative data for the performance of a mass spectrometer in which an ion lens assembly according to the present teachings are incorporated for the following cases: (A) the ion lens assembly was not heated, (B) the ion lens assembly was heated to a temperature of 100° C., and (C) the ion lens assembly was heated to a temperature of 130° C.
Figure 17:
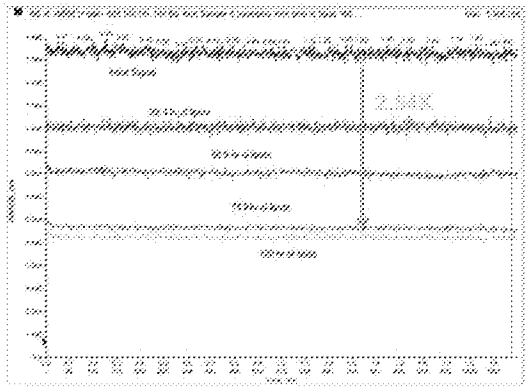
Figure 17:
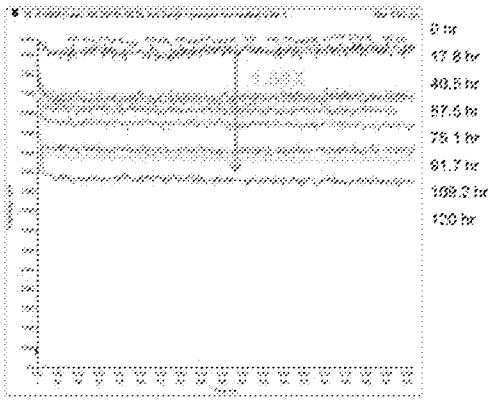

Accelerated robustness tests were conducted using a standard test of infusing a contaminant solution of diluted olive oil for various durations into the mass spectrometry system. Each test involved infusing the contamination solution for 120 hours while monitoring system performance using a reserpine standard at various time points. These experiments were conducted under three different temperature conditions. First, the ion lens assembly was installed but heater element was not radiating. FIG. 17 at panel (A) depicts exemplary mass signal data obtained using an ion lens assembly according to present teachings without activating the assembly's heating element. This data shows a total signal decrease of 3.6× for reserpine ions after 120 hours of lipid infusion. Second, the heating element of the ion lens assembly was activated and the ion lens assembly was maintained at a temperature of 100° C. while mass data depicted in FIG. 17 at panel (B) was obtained. This data shows a total signal decrease of 2.5× for reserpine ions after 120 hours of lipid infusion. Third, the ion lens assembly was maintained at 130° C. while mass data depicted in FIG. 17 at panel (C) was obtained. This data shows a total signal decrease of 1.7× for reserpine ions after 120 hours of lipid infusion. The above data suggests that heating of the ion lens assembly was beneficial for system robustness. That is, the signal reduction for reserpine ions after 120 hours of lipid infusion was 3.6×, 2.5×, and 1.7× when the ion lens assembly was not heated, heated to 100° C., and heated to 130° C., respectively.

Figure 18:
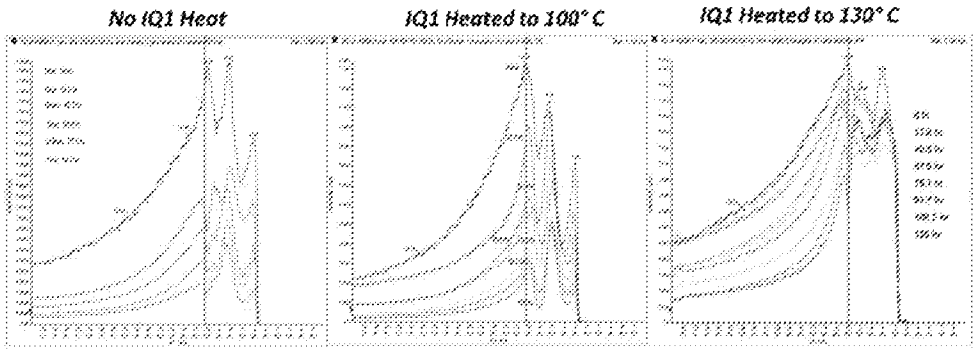
FIG. 18 depicts comparative data for powering and/or ramping of an ion lens assembly in which an ion lens assembly according to the present teachings is incorporated for the following cases: (A) ion lens assembly was not heated, (B) the ion lens assembly was heated to a temperature of 100° C., and (C) the ion lens assembly was heated to a temperature of 130° C.

FIG. 18 depicts exemplary data for powering and/or ramping of an ion lens assembly to operation taken over the course of highly accelerated robustness testing using a custom ion lens assembly maintained at three different temperatures. A comparison of ramping data for the ion lens assembly was acquired over the course of three different contamination experiments. In each case, for comparison, a vertical line is overlaid on data, which approximately corresponds to the operating point for the ion lens assembly potential (~−10.2 V). The experiments were conducted under three different temperature conditions. First, the ion lens assembly was installed but the heating element was not activated to heat the ion lens assembly while obtaining the data depicted FIG. 18 at panel (A). Substantial changes in the ion lens assembly ramp shape were observed when no heat was applied to the ion lens assembly, and the signal dropped substantially at the operating point. Second, the heating element of the ion lens assembly was activated and the ion lens assembly was maintained at 100° C. while the data depicted in FIG. 18 at panel (B) was acquired. Increasing the temperature of the ion lens assembly to 100° C. improved the performance somewhat, but a substantial signal decrease was still observed over time. Third, the ion lens assembly was maintained at 130° C. while the data depicted in FIG. 18 at panel (C) was obtained. An increase in the ion lens assembly heater temperature to 130° C. resulted in a smaller change in the ion lens assembly ramp profile over the course of highly accelerated robustness experiments. The signal dropped by a much smaller extent at the standard operating point, and the general shape of the ramps was more constant over the course of 120 hours. The data in FIG. 17 suggests that, at least in some cases, the application of more heat to the ion lens assembly eliminates dramatic changes in the optimal lens value.

Figure 19:
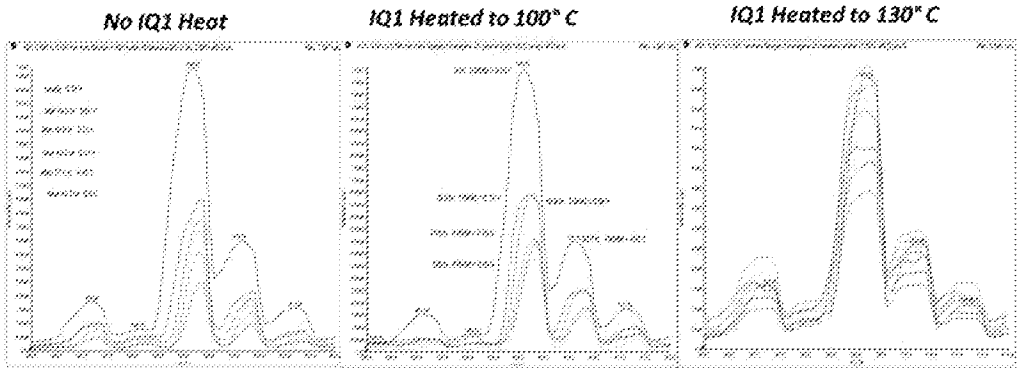
FIG. 19 depicts comparative data for powering and/or ramping of an ion lens assembly according to the present teachings incorporated in a mass spectrometry system for the following cases: (A) the ion lens assembly was not heated, (B) the ion lens assembly was heated to a temperature of about 100° C., and (C) the ion lens assembly was heated to a temperature of about 130° C.

In a series of experiments, Q1 peak shape data was obtained over the course of highly accelerated robustness testing using an ion lens assembly according to the present teachings. The experiments were conducted under three different temperature conditions. First, the ion lens assembly was installed but the heating element was not activated while the data depicted in FIG. 19 at panel (A) was acquired. With no heat applied to the ion lens assembly, the Q1 peak width decreased from 1 V to 0.40 V. Second, the ion lens assembly was maintained at 100° C. while the data depicted in FIG. 19 at panel (B) was acquired. With the ion lens assembly maintained at a temperature of 100° C., the Q1 peak width still exhibited narrowing, however the final width was 0.50 V. Third, the ion lens assembly was maintained at 130° C. while the data depicted in FIG. 19 at panel (C) was acquired. With the ion lens assembly maintained at 130° C., narrowing of the Q1 peak was not observed. These results suggest that heating of the ion lens assembly to prevent material deposition can preserve signal for longer periods of time by maintaining Q1 peak shape. Conversely, over-resolving of the Q1 assembly can occur when debris accumulates on the ion lens assembly and causes charging. As noted above, this data further suggests that, at least in certain cases, the application of more heat to the ion lens assembly eliminates dramatic changes in the optimal lens value.

Figure 20:
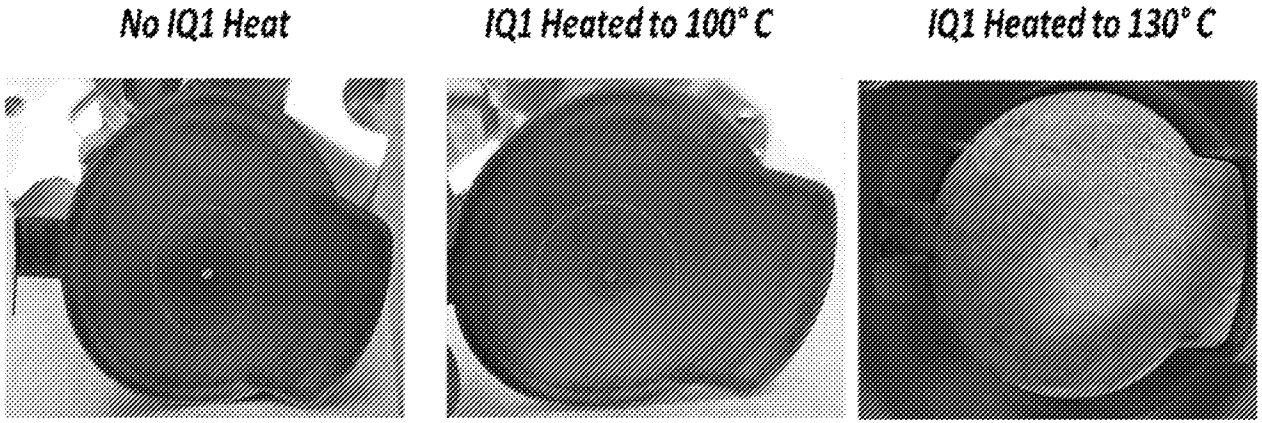
FIG. 20 depicts images of an ion lens assembly according to the present teachings after robustness testing for the following cases: (A) the ion lens assembly was not heated, (B) the ion lens assembly was heated to a temperature of about 100° C., and (C) the ion lens assembly was heated to a temperature of about 130° C.

A series of experiments were performed to assess long-term robustness of an ion lens assembly according to the present teachings incorporated in a mass spectrometry system. Experiments were conducted under three different temperature conditions. Each of the ion lens assembly was visually inspected at the end the highly accelerated robustness tests. First, the ion lens assembly was installed but the heating element was not activated. FIG. 20 at panel (A) depicts an image of a forward surface of the ion lens assembly at the end of a robustness testing, which lasted about 120 hours, when the heating element was not activated. A large deposit was visible surrounding the aperture of the forward surface of the lens. This deposit was comparable in size to typical deposits that are observed on the surface of standard the ion lens assembly. Second, the ion lens assembly was maintained at 100° C. FIG. 20 at panel (B) depicts image of the ion lens at the end of long term robustness testing where the ions lens was maintained at a temperature of about 100° C. The diameter of the visible deposit was much smaller on the lens that was operated at a temperature of 100° C. Given the design of the heater assembly and the relatively poor thermal transfer characteristics of stainless steel, it seems likely that the region around the aperture would have been at a temperature less than 100° C. for these experiments. Third, the ion lens assembly was maintained at 130° C. FIG. 20 at panel (C) depicts an image of the ion lens at the end of long term robustness testing where the ions lens was maintained at a temperature of about 130° C. Finally, when the ion lens assembly was maintained at a temperature of 130° C., where no visible deposit was observed on the surface of the lens at an end of a robustness testing. The diameter of visible deposits on the surface of the ion lens assembly decreased when the ion lens assembly was maintained at higher temperature. These results suggest that, in at least some cases, the increase in the temperature of the ion lens assembly can result in a decrease in the accumulation of contamination debris on the surfaces of the ion lens assembly.

Figure 21:
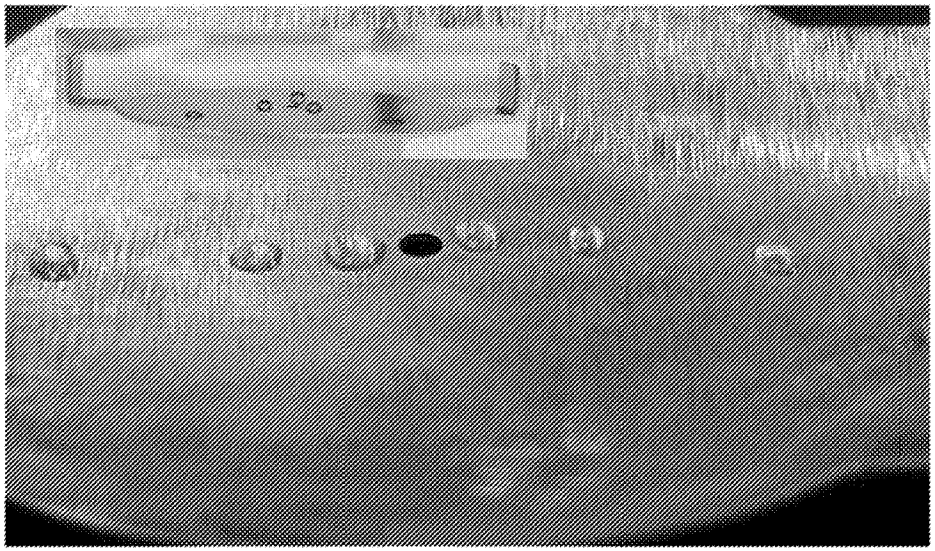
FIG. 21 depicts contact angle data.
Figure 21:
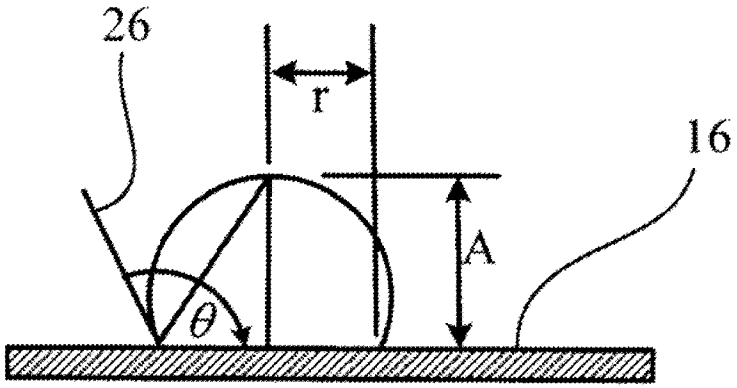

In a series of experiments, a contact angle test for a water droplet was employed to assess the presence of invisible hydrophobic materials in the region around the ion lens assembly aperture. FIG. 21 (A) shows six water droplets on the surface of the ion lens assembly that had been maintained at 130° C. during a highly accelerated contamination test. In all cases, the observed contact angle was small for these droplets, and this is consistent with what is typically observed when using concentrated powder instrument cleaner to clean these types of lenses. For comparison purposes, FIG. 21 at panel (A—[in the inset]) shows a contact angle test for a standard lens at the end of a similar robustness test. In the case of the photograph shown in the inset, steep contact angles are observed for the water droplets in the vicinity of the ion lens assembly aperture. Such steep contact angles are consistent with the deposit of hydrophobic lipid materials over the course of the experiments. FIG. 21 at panel (B) shows a cross-sectional view of a schematic rendition of droplet of water on a surface and illustrates a method for determining contact angle. Generally, to measure contact angle, θ, for a liquid (such as water) on a surface 16, an angle is measured between the surface 16 and a tangent line 26 drawn to a droplet surface of the liquid at a three-phase point. Mathematically, θ is 2 arctan(A/r), where A is the height of the droplet image, and r is half width at the base. In some embodiments, it can be desirable to have contact angle, θ, measured using deionized water, of less than about 150 degrees, for example, less than about 125 degrees, less than about 100 degrees, less than about 75 degrees or even less than about 50 degrees. In other embodiments, it can be desirable to have contact angle θ above about 35 degrees, for example, above about 40 degrees, above about 45 degrees. The images suggest that heating the ion lens assembly limits the deposition of contaminating material during highly accelerated robustness experiments.

In some experiments, with the ion lens assembly maintained at 130° C., there was no visible indication of debris on the surface of the ion lens assembly after 120 hours of lipid infusion, and water droplet experiments also showed no indication of the presence of hydrophobic material on the ion lens assembly. Moreover, it was not necessary to clean the ion lens assembly to restore system performance. Furthermore, no significant improvement to system performance was observed when cleaning the ion lens assembly.

Figure 22:
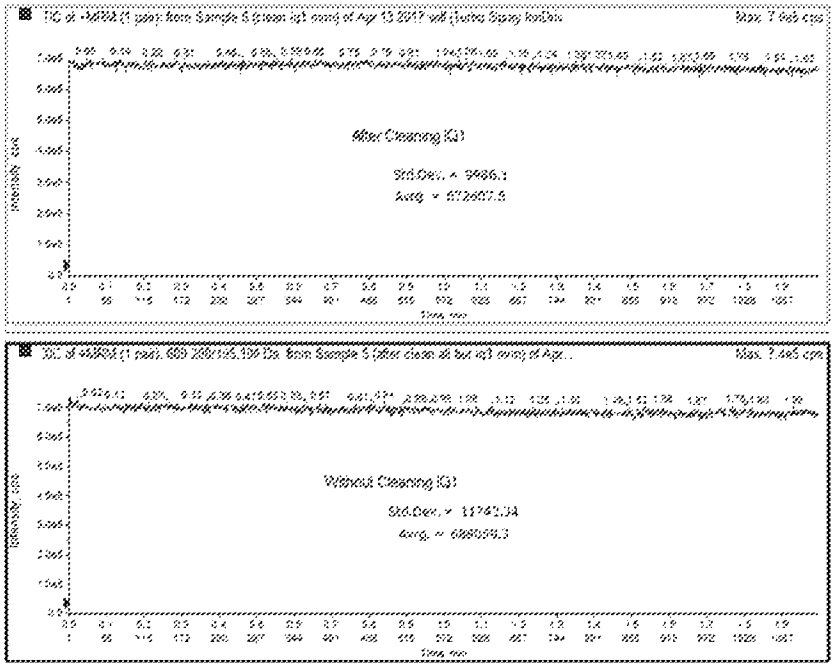
FIG. 22 depicts exemplary comparative data for performance of a mass spectrometry system in which a heated ion lens assembly according to the present teachings is used as an IQ1 lens after cleaning and without cleaning the lens.

FIG. 22 depicts exemplary data showing a collection of mass spectrometry signals by a mass spectrometry system in which an ion lens assembly according to the present teachings was incorporated, indicating that the ion lens assembly that was maintained at 130° C. throughout a contamination experiment behaved the same as a clean ion lens. Specifically, the contamination included Reserpine MRM leaked into the chamber for 120 hours and the cleaning included heating the ion lens at a temperature of about 130° C. from the curtain plate to the Q1 assembly, except for the IQ1 lens. A series of baseline experiments were performed and then the ion lens assembly was cleaned using a standard or typically used cleaning procedure and the instrument was rebaselined. In this manner, it was possible to determine if the "visually clean" ion lens assembly behaved like a clean lens. FIG. 22 at panel (A) depicts signal data after cleating the IQ1 lens. FIG. 22 at panel (B) depicts signal data without cleaning the IQ1 lens signal intensity and count rate stability were indistinguishable. These results further support the premise that heating the ion lens assembly to an appropriate temperature can prevent the accumulation of debris that would otherwise lead to a degradation of the performance of the mass spectrometry system. In particular, the data shows that, when the ion lens assembly was maintained at a temperature of 130° C., there was no indication of debris on the ion lens assembly surface after 120 hours of lipid infusion and hence there was no need to clean the ion lens assembly.

The present disclosure is not limited to the embodiments described and exemplified above but is capable of variation and modification within the scope of the appended claims. The section headings used herein are for organizational purposes only and are not to be construed as limiting. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art.

Various publications, including patents, published applications, technical articles and scholarly articles are cited throughout the specification. Each of these cited publications is incorporated by reference herein, in its entirety and for all purposes.

Those having ordinary skill in the art will appreciate that various changes can be made to the above embodiments without departing from the scope of the invention.

What is claimed is:

1. An ion lens assembly for use in a mass spectrometry system, comprising:

a plurality of layers, comprising:

a front cap layer having a forward surface arranged to face incoming ions;

a rear layer; and a heating element disposed between the front cap layer and the rear layer, wherein each layer of the plurality of layers comprises an opening, the opening of each layer being substantially aligned and sized to allow passage of ions through the ion lens assembly.

2. The ion lens assembly of claim 1, wherein the heating element is electrically isolated from the front cap layer and the rear layer.

3. The ion lens assembly of claim 2, further comprising:

a first insulating layer disposed between the front cap layer and the heating element; and a second insulating layer disposed between the heating element and the rear layer.

4. The ion lens assembly of claim 3, wherein the first and second insulting layers comprise a dielectric material, glass, plastic, ceramic, natural crystal, paper, natural or synthetic polymeric material, stone, and/or or non-conductive metal oxide film.

5. The ion lens assembly of claim 1, wherein layers of the plurality of layers comprise a thin film coating.

6. The ion lens assembly of claim 1, wherein the front cap layer and the rear layer are electrically conductive.

7. The ion lens assembly of claim 1, wherein the front cap layer and the rear layer are configured to receive a same voltage.

8. The ion lens assembly of claim 1, wherein the front cap layer and the rear layer comprise aluminum, ceramic, copper, gold, and/or stainless steel.

9. The ion lens assembly of claim 1, wherein the heating element further comprises an electrical connection configured to apply electrical power to the heating element.

10. The ion lens assembly of claim 1, wherein the ion lens assembly has a thickness of about 0.2 mm to about 10 mm, wherein the thickness is from the forward surface of the front cap layer to a backward surface of the rear layer.

11. The ion lens assembly of claim 1, wherein the heating element comprises a resistive electrical trace, or a flexible heater.

12. The ion lens assembly of claim 1, wherein the heating element is designed and constructed to heat the ion lens assembly to a temperature of about 100° C. to about 300° C.

13. The ion lens assembly of claim 1, wherein the opening in at least one layer of the plurality of layers is approximately circular.

14. The ion lens assembly of claim 1, wherein the opening in each layer is about 0.1 mm to about 10 mm, in at least one dimension.

15. The ion lens assembly of claim 1, further comprising a feedback element is disposed between the front cap layer and the rear layer to measure a temperature of the ion lens assembly.

16. The ion lens assembly of claim 15, wherein the feedback element comprises a resistive electrical trace.

17. The ion lens assembly of claim 15, wherein the feedback element comprises a resistance temperature detector, (RTD).

18. The ion lens assembly of claim 1, wherein the heating element comprises a plurality of pins for electrical connection.

19. The ion lens assembly of claim 18, wherein at least one of the pins is configured to connect the heating element to an external temperature sensor.

20. A mass spectrometry system, comprising:
- an ion source for generating ions;
- one or more ion guide chambers positioned downstream from the ion source for receiving ions, the one or more ion guide chambers comprising:
  - an inlet orifice for receiving ions generated from the ion source; and
  - at least one exit orifice for transmitting ions to a mass analyzer; and
- the ion lens assembly of any of the preceding claims positioned downstream from at least one of the one or more ion guide chambers.

21. The mass spectrometry system of claim 20, wherein the heating element is designed and constructed to heat the ion lens assembly to a temperature in a range of about 100° C. to about 300° C.

22. The mass spectrometry system of claim 21, further comprising a heater circuit in communication with the heating element of the ion lens assembly and configured to apply electrical power to the heating element.

23. The mass spectrometry system of claim 22, further comprising a feedback element in communication with the heating element, the feedback element configured to measure a temperature of the ion lens assembly.

24. The mass spectrometry system of claim 23, further comprising a controller in communication with the feedback element and the heater circuit, the controller receiving temperature data from the feedback element and regulating the temperature of the ion lens assembly within a desired temperature range.

25. The mass spectrometry system of claim 20, wherein the ion lens assembly is configured such that a sticking coefficient of ions and neutral species at the forward surface of the front cap layer is reduced when the ion lens assembly is at a temperature between 100-300° C.

26. A method of making an ion lens assembly, comprising steps of:
- providing a rear layer;
- coupling a heating element with the rear layer;
- coupling a front cap layer with the heating element, the front cap layer having a forward surface arranged to face incoming ions;
- wherein each layer comprises an opening, the opening of each layer being substantially aligned and sized to allow passage of ions through the ion lens assembly.

27. The method of claim 26, wherein the step of coupling the heating element with the rear layer, comprises steps of:
- applying a first insulating layer to a forward surface of the rear layer;
- contacting a heating element with the first insulating layer;
- applying a second insulating layer to the heating element; and
- contacting an electrically conducting layer with the second insulating layer.

28. The method of claim 27, where the steps of applying comprise depositing and/or coating.

29. The method of claim 28, further comprising steps of:
- providing a heater circuit;
- connecting the heating element with the heater circuit;
- providing a feedback element;
- coupling the feedback element between the front cap layer and the rear layer of the ion lens assembly; and
- connecting the feedback element with the heater circuit.

30. A method of reducing ion lens assembly contamination in a mass spectrometry system, comprising steps of:
- providing an ion lens assembly having a heating element and a feedback element disposed between a front cap layer and a rear layer, the heating element being electrically connected to a heater circuit;
- using the heater circuit to apply an electrical current to the heating element, wherein at least a portion of the heating element exhibits an electrical resistance generating heat in response to the applied electrical current for directly heating the ion lens assembly;
- controlling a temperature of the ion lens assembly, comprising steps of:
  - providing a controller;
  - connecting the controller with the heater circuit and the feedback element, so that the controller is in communication with the heating element and the feedback element;
  - receiving by the controller temperature data from the feedback element; and controlling by the controller the heater circuit in response to the temperature data so as to regulate a temperature of the ion lens assembly within a desired temperature range.

31. The method of claim 30, wherein the desire temperature range is about 100° C. to about 300° C.

32. The method of claim 30, wherein the heating element comprises at least one conduit plumbed for a fluid to flow therethrough.

33. The method of claim 32, wherein the fluid is a preheated fluid.

34. The method of claim 32, wherein the fluid is two or more reagents that upon contact and/or mixing exothermically generate heat.

35. The method of claim 30, wherein the heating element comprises a thermoelectric device.

36. The method of claim 30, further comprising at least one temperature sensor mounted to the front cap layer or the rear layer.

* * * * *